US005479897A

United States Patent [19]

Kawai et al.

[11] Patent Number: 5,479,897

[45] Date of Patent: Jan. 2, 1996

[54] CONTROL APPARATUS FOR INTERNAL COMBUSTION ENGINE

[75] Inventors: Katsuhiko Kawai; Hisayo Douta; Hiroshi Ikeda, all of Kariya, Japan

[73] Assignee: Nippondenso Co., Ltd., Kariya, Japan

[21] Appl. No.: 293,243

[22] Filed: Aug. 19, 1994

[30] Foreign Application Priority Data

Aug. 20, 1993 [JP] Japan ..... 5-206671
Sep. 22, 1993 [JP] Japan ..... 5-236860

[51] Int. Cl.[6] ..... F02M 3/00

[52] U.S. Cl. ..... 123/339.2

[58] Field of Search ..... 123/339, 478, 123/339.2; 364/431.06

[56] References Cited

U.S. PATENT DOCUMENTS

| | | | |
|---|---|---|---|
| 4,785,780 | 11/1988 | Kawai | 123/339 |
| 5,070,837 | 12/1991 | Nishimura et al. | 123/339 |
| 5,094,213 | 3/1992 | Dudek et al. | 123/478 |
| 5,184,588 | 2/1993 | Kato et al. | 123/339 |
| 5,243,952 | 9/1993 | Ikuta et al. | 123/682 |
| 5,249,558 | 10/1993 | Imamura | 123/339 |
| 5,269,271 | 12/1993 | Kawai et al. | 123/339 |
| 5,269,272 | 12/1993 | Nakaniwa | 123/339 |
| 5,365,903 | 11/1994 | Watanabe | 123/339 |
| 5,383,126 | 1/1995 | Oogawa et al. | 364/431.06 |
| 5,383,430 | 1/1995 | Kamiya | 123/339 |

FOREIGN PATENT DOCUMENTS

| | | | |
|---|---|---|---|
| 185552 | 6/1986 | European Pat. Off. | 123/339 |
| 63-195355 | 8/1988 | Japan . | |
| 45452 | 1/1992 | Japan . | |

*Primary Examiner*—Raymond A. Nelli
*Attorney, Agent, or Firm*—Cushman, Darby & Cushman

[57] ABSTRACT

In order to optimally suppress effects of error exerted upon control results by any modeling error which may arise from load fluctuations or the like of the internal combustion engine approximated as a dynamic model under an advanced control theory, present and past values of an operating quantity and control quantity which correspond respectively to a control input and control output of an internal combustion engine are utilized as state variable quantities representing the internal state of the dynamic model of an internal combustion engine. Furthermore, the target value and difference are accumulated for the foregoing control quantity. Modeling of the internal combustion engine is performed in realtime, and optimal feedback gain is calculated periodically or under certain specified conditions for a regulator constructed on the basis of these model constants calculated in realtime. The operating quantity for the internal combustion engine is determined on the basis of this calculated optimal feedback gain, the foregoing state variable quantities, and the foregoing accumulated difference value.

6 Claims, 11 Drawing Sheets

CONTROL APPARATUS FOR INTERNAL COMBUSTION ENGINE

BACKGROUND OF THE INVENTION

The present invention relates to a control apparatus for an internal combustion engine which performs multivariable control to approximate a dynamic model of an internal combustion engine taken as a target of control and thereby causes the behavior thereof to approach a target value. More particularly, this invention relates to a control apparatus structure which optimally suppresses effects exerted upon control results by modeling error arising from load fluctuations or the like of the internal combustion engine approximated as the dynamic model.

Known control apparatuses of this type include, for example, an apparatus disclosed in Japanese Patent Application Laid-open No. 64-8336 (U.S. Pat. No. 4,785,780), an apparatus disclosed in Japanese Patent Application Laid-open No. 4-5452, and an apparatus disclosed in Japanese Patent Application Laid-open No. 4-279749 (U. S. Pat. No. 5,184,588). Each of these control apparatuses considers the internal combustion engine as a dynamic system with consideration to the internal state of the engine, determining input variables of the engine while estimating the dynamic behavior of the engine by means of state variables which prescribe the internal state thereof. I.e., a method of state variable control based on what is known as modern or advanced control theory is employed in order to control the speed of the internal combustion engine when idling i.e., the idle speed.

Normally, as a means for estimating the internal state of an internal combustion engine which is the controlled object in this type of state variable control based on modern control theory, a state monitor termed an observer is employed. The observer's role to periodically estimate state variable quantities of the internal combustion engine from operating quantities (control input information) of the engine and control quantities (control output information) of the engine. However the apparatuses described in these publications are made to output specific control quantities and operating quantities such as the speed of the internal combustion engine and the operating quantity of idle air as state variable quantities representing the internal state of a dynamic model of the internal combustion engine, thereby obviating the construction of this observer and even alleviating complication when modeling the controlled object. The state variable quantities which are output in this manner undergo, for example, integral compensation according to the accumulation value of the difference from the target value of the idle speed detected as the above-mentioned control quantity. Furthermore, as an operating quantity capable of converging the state feedback system at high speed on the basis of the predetermined optimal feedback gain of the relevant model, it is given to an actuator which acts upon, for example, the above-mentioned idle air.

By providing the above-mentioned control apparatus of the prior art with means for outputting specific control quantities and operating quantities as state variable quantities representing the internal state of the dynamic model of the internal combustion engine in this manner, reliable error-free accuracy and prompt control are made possible for the relevant state variable quantities while having a comparatively simple control device structure which obviates the construction of the above-mentioned observer.

It is to be noted that the above-mentioned state variable quantities themselves are output as values tracking the internal fluctuations of the internal combustion engine taken as the controlled object, and this makes for a control method in which this state variable control performed on the basis of modern control theory is resistant to modeling error.

With regard to the above-mentioned optimal feedback gain, however, because this is normally predetermined as a coefficient which is specific to the internal combustion engine approximated as the dynamic model, the modelling errors cannot be ignored in the event that such modeling error occurs. For this reason, if large fluctuations occur in the internal combustion engine taken as the controlled object, the reliability of the feedback gain itself becomes doubtful, and desirable state feedback is not necessarily maintained as the control apparatus.

SUMMARY OF THE INVENTION

It is a primary object of the present invention to overcome the drawbacks of the prior art apparatus.

The present invention provides a control apparatus for an internal combustion engine capable of effectively suppressing the effects of modelling errors on control results even if such modeling errors arise due to load fluctuation or the like in the internal combustion engine approximated as a dynamic model.

According to the present invention, as shown in FIG. 11 a control apparatus for an internal combustion engine is provided with an actuator M1 which operates a running state of an internal combustion engine, running state detection means M2 which detects the control quantity in the running state of the internal combustion engine, state variable quantity output means M3 which outputs the present and past operating quantities of the actuator M1 as well as the present and past control quantity values detected by the running state detection means M2 as state variable quantities representing an internal state of a dynamic model of the internal combustion engine, difference accumulation means M4 which accumulates differences between the control quantity value detected by the running state detection means M2 and its target value, model constant calculation means M5 which calculates a model constant in realtime as a dynamic model of the internal combustion engine on the basis of the past operating quantity of the actuator M1 as well as the present and past control quantity values detected by the running state detection means M2, feedback gain calculation means M6 which employs a specified evaluation function to calculate the optimal feedback gain for a regulator constructed on the basis of the calculated model constant, and operating quantity calculation means M7 which calculates the operating quantity of the actuator on the basis of the calculated optimal feedback gain, the state variable quantity output from the state variable quantity output means M3, and the difference accumulation value of the difference accumulation means M4.

In a case of controlling, for example, idle speed of an internal combustion engine, the idle air quantity serves as the operating quantity operated by the actuator M1, and the idle speed serves as the control quantity detected by the running state detection means M2. In this case, consequently, the state variable quantity output means M3 serves to output the present and past operating quantities for the idle air quantity as well as the present and past speed values detected for the idle speed as the state variable quantities representing the internal state of the dynamic model of the internal combustion engine, and the difference accumulation means M4 serves to accumulate the difference between this detected idle speed value and the target speed.

Similarly, in a case of controlling air-fuel ratio of the internal combustion engine, the rate of fuel supply serves as the operating quantity operated by the actuator M1, and the air-fuel ratio serves as the control quantity detected by the running state detection means M2. In this case, consequently, the state variable quantity output means M3 serves to output the present and past operating quantities for the rate of fuel supply as well as the present and past speed values detected for the air-fuel ratio as the state variable quantities representing the internal state of the dynamic model of the internal combustion engine, and the difference accumulation means M4 serves to accumulate the difference between this detected air-fuel ratio value and the target air-fuel ratio.

As has been described above, the model constant calculation means M5 calculates a model constant in realtime as a dynamic model of an internal combustion engine on the basis of the past operating quantity of the actuator M1 as well as the present and past control quantity values detected by the running state detection means M2, and the feedback gain calculation means M6 calculates the optimal feedback gain for the regulator constructed on the basis of the model constant calculated in realtime in this manner. That is to say, this control apparatus is such that the modeling of the controlled object is performed in realtime, and modeling error is naturally avoided, even if fluctuation occurs in the internal combustion engine taken as the controlled object. Moreover, the calculated optimal feedback gain also naturally becomes a value which conforms with the periodic state of the internal combustion engine modeled without this error.

Because of this, if the operating quantity calculation means M7 is made to employ optimal feedback gain which conforms with the periodic state of the internal combustion engine modeled without this error while performing integral compensation for the state variable quantity output from the state variable quantity output means M3 on the basis of the accumulation values according to the difference accumulation means M4, thereby calculating the operating quantity of the actuator M1 which can converge the state feedback system for the relevant model at high speed, the effect of fluctuation exerted upon the control result is naturally suppressed even if some fluctuation occurs in the internal combustion engine approximated as the dynamic model, and with regard to, for example, speed control during idling or control of air-fuel ratio, constantly stable state variable control which conforms to the periodic state of the internal combustion engine is thereby maintained.

Furthermore, with regard to calculation of the above-mentioned optimal feedback gain by the feedback gain calculation means M6, it is of course acceptable to perform this in realtime in parallel with the above-mentioned modeling of the controlled object. But in consideration of overall operational efficiency as a control apparatus, it is preferable for the feedback gain calculation means M6 to be further structured so as to monitor the fluctuation quantity of the model constant calculated by the above-mentioned model constant calculation means M5, recalculate this optimal feedback gain only when a model constant fluctuation greater than a specified quantity is confirmed, and maintain the optimal feedback gain until then at the other times.

DETAILED DESCRIPTION OF THE INVENTION

Figure 1:
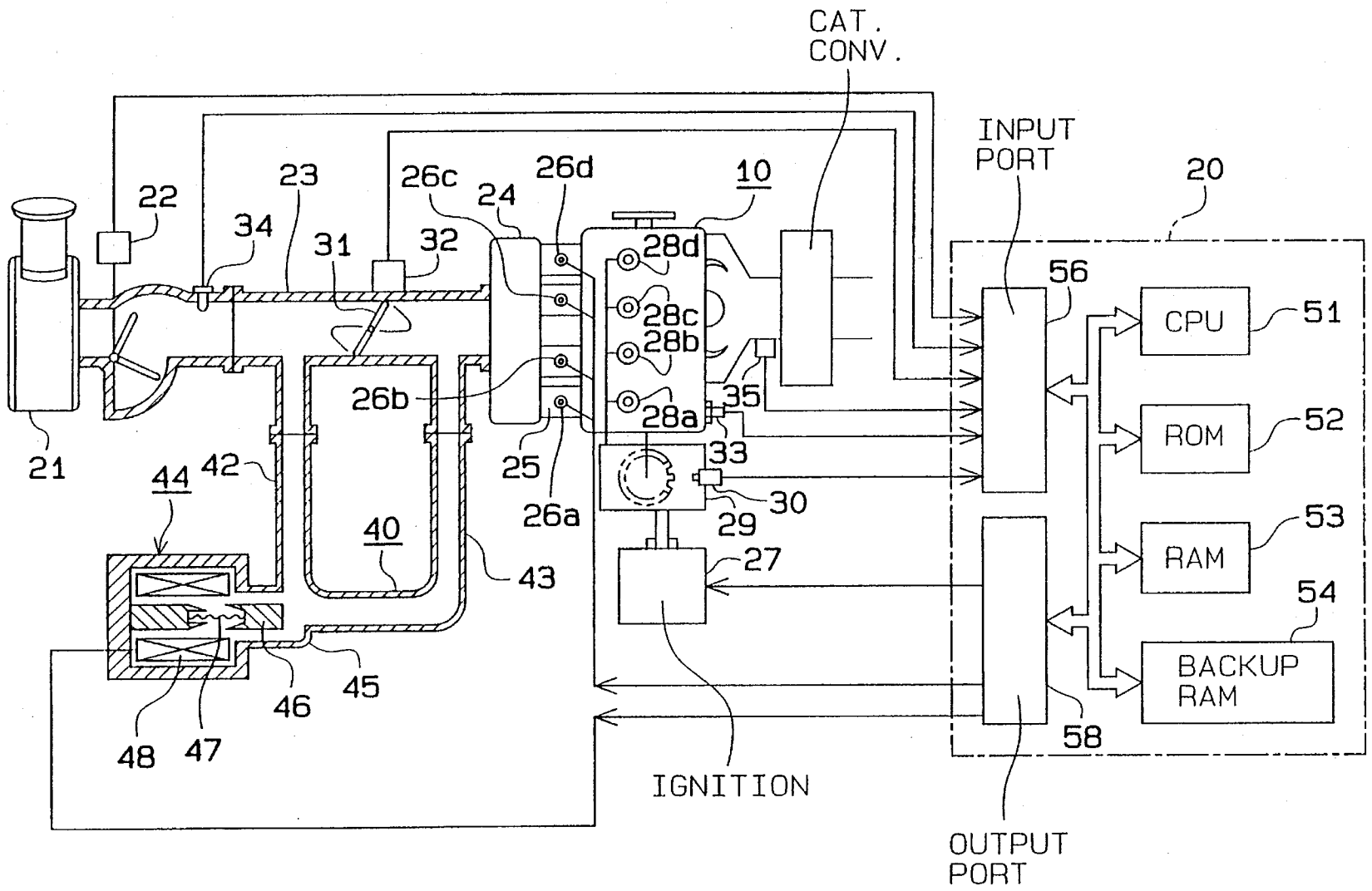
FIG. 1 is a block diagram of a control apparatus for an internal combustion engine according to an embodiment of the present invention.

As an embodiment of a control apparatus according to the present invention, FIG. 1 is a diagram showing an internal combustion engine (engine) mounted on a vehicle, and an electronic control unit.

First, the structure of the engine taken as the controlled object and the electronic control unit of this embodiment will be described with reference to FIG. 1.

As is shown in FIG. 1, a 4-cylinder, 4-cycle spark-ignition type engine is envisioned as the engine 10. The intake air passes sequentially from upstream via an air cleaner 21, air flow meter 22, air intake duct 23, surge tank 24, and respective air intake branch tubes to enter the respective cylinders. Fuel is pumped from a fuel tank (not shown) to fuel injection valves 26*a*, 26*b*, 26*c* and 26*d* which are attached to the respective air intake branch tubes 25 and which serve to supply fuel.

In the engine 10, high-tension electrical signals supplied from an ignition circuit 27 are sequentially applied from a distributor 29 to spark plugs 28*a*, 28*b*, 28*c* and 28*d* provided within the respective cylinders. Disposed within this distributor 29 is an engine rotational speed sensor 30 which detects the speed Ne of the engine 10. Provided further are a throttle sensor 32 which detects the opening degree of a throttle valve 31, a coolant temperature sensor 33 which detects the temperature of the engine coolant, an intake air temperature sensor 34 which similarly detects the temperature of the intake air, and an air-fuel ratio sensor 35 which detects the actual uncombusted oxygen concentration in exhaust gas upstream of a 3-way catalytic converter within an exhaust pipe and outputs this as an air-fuel ratio sensor signal λ. In this connection, the air-fuel ratio sensor signal λ output from the above-mentioned air-fuel ratio sensor 35, in such cases, assumes a linear value in relation to the actual air-fuel ratio of the air-fuel mixture supplied to the engine 10. The engine speed sensor 30 is disposed so as to oppose a gear which rotates in synchronization with the crankshaft of the engine 10, and outputs 24 pulse signals while the engine crankshaft rotates two turns (720°). The above-mentioned throttle sensor 32 outputs an analog signal depending on the degree of opening of the throttle valve 31, together with outputting an on-off signal from an idle switch which detects when the throttle valve 31 is essentially fully closed.

Within the air intake system of the engine 10 is provided a bypass passage 40 which bypasses the throttle valve 31 and which controls the amount of air intake during idling of the engine 10. The bypass passage 40 consists of air tubes 42 and 43 and an idle speed control valve 44 (hereinafter termed an ISC valve). This ISC valve 44 is basically a linear solenoid valve, and variably controls the air passage area between the above-mentioned air tubes 42 and 43 according to the position of a valve member 46 provided movably within a housing 45. The ISC valve 44 is normally set so that the valve member 46 is in a state whereby the above-mentioned air passage area becomes zero by means of a compression helical spring 47, but the valve member 46 is driven and the air passage is opened by means of excitation current flowing through a winding 48. That is to say, the bypass air flow can be controlled by continuously varying the excitation current for the winding 48. In this case, the excitation current for the winding 48 is controlled by what is known as pulse-width modulation (PWM), which controls the duty ratio of the pulse width applied to the winding 48.

Moreover, this ISC valve 44 is driven and controlled by the electronic control unit 20, similarly to the above-mentioned fuel injection valves **26*a* to 26*d* and the ignition circuit 27** and, in addition to the linear solenoid valve described above, may be of the diaphragm type, the type controlled by a stepping motor, or the like.

The electronic control unit 20 is composed of a microcomputer having primarily a known central processing unit (CPU) 51, read-only memory (ROM) 52, random-access memory (RAM) 53, backup RAM 54, and the like. The microcomputer is mutually connected via a bus to an input port 56 which performs input from the respective above-mentioned sensors, an output port 58 which outputs control signals to the respective actuators, and so on. The electronic control unit 20 inputs sensor signals for the above-mentioned intake air flow, intake air temperature, throttle opening degree, coolant temperature, engine speed Ne, air-fuel ratio λ and so on via the input port 56, calculates the fuel injection amount TAU, ignition timing, ISC valve opening degree Q, and the like on the basis of these sensor signals, and outputs the respective control signals to the fuel injection valves **26*a* to 26*d*, ignition circuit 37, and ISC valve 44**.

Figure 2:
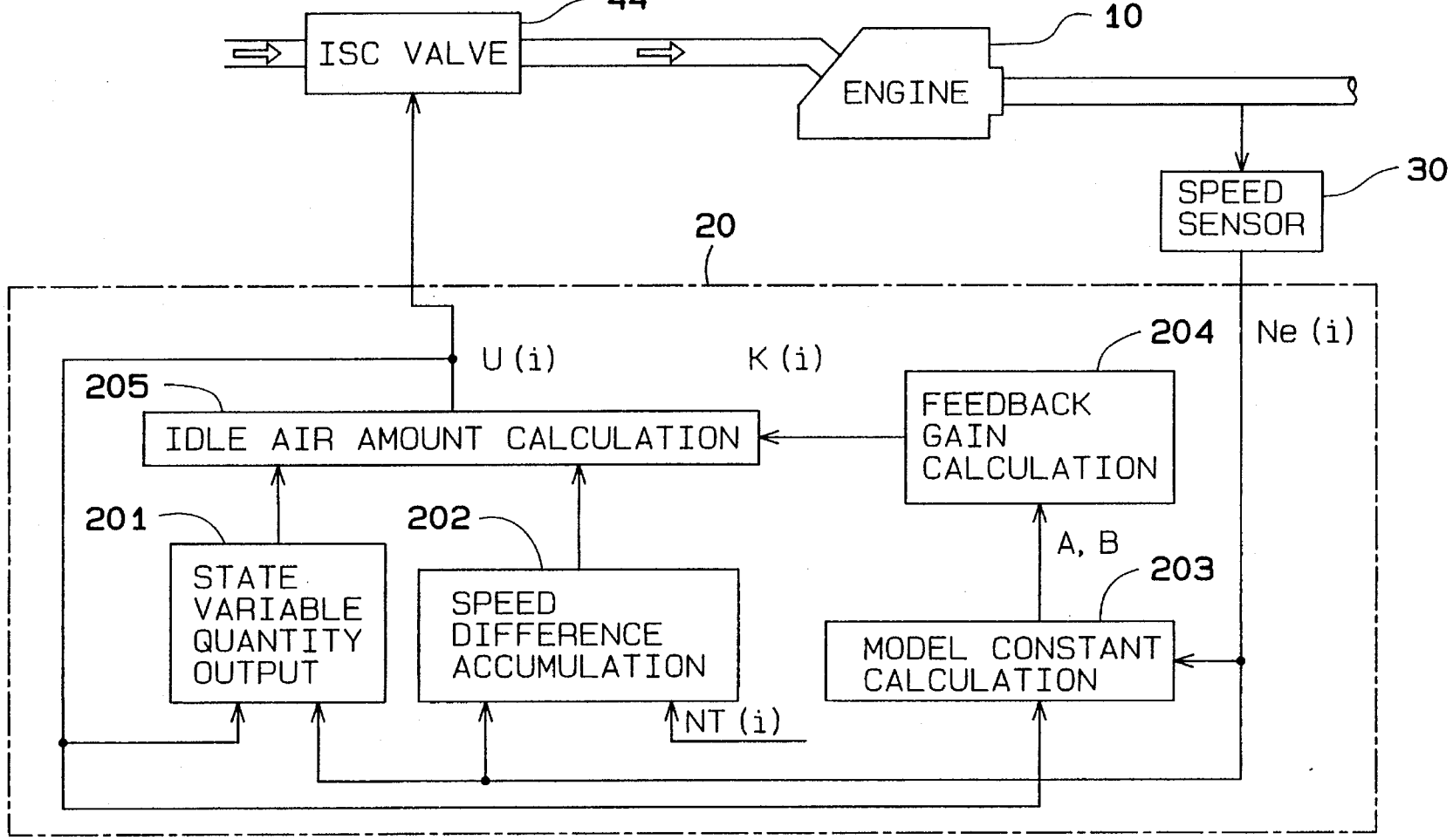
FIG. 2 is a block diagram of the functions and connections between functions in the case of control for idle speed by an apparatus, and primarily the electronic control unit, of the embodiment.

As an example of the control apparatus of this embodiment, the model shown in FIG. 2 takes the amount of idle air as the operating quantity (control input), takes the engine speed (idle speed) as the control quantity (control output), and models the above-mentioned engine 10. The control states as a device for performing idle speed control for the engine 10 will be described in detail hereinbelow.

In FIG. 2, a state variable quantity control output section 201 forming the electronic control unit 20 outputs present and past operating quantities according to the above-mentioned ISC valve 44 as an actuator, as well as the present and past control quantity values detected by the above-mentioned engine speed sensor 30 as a running state detection means, as a state variable quantity representing the internal state of the dynamic model of the engine 10. Similarly, an engine speed difference accumulation section 202 accumulates the difference between the control quantity value Ne(i) detected by the above-mentioned speed sensor 30 and its target value NT(i). Also similarly, a model constant calculation section 203 calculates the model constant in realtime as the dynamic model of the engine on the basis of the past operating quantity of the above-mentioned ISC valve 44 as well as the present and past control quantity values detected by the above-mentioned speed sensor 30. The feedback gain calculation section 204 employs a specified evaluation function to calculate the optimal feedback gain for the regulator constructed on the basis of this calculated model constant. Additionally, an idle air amount calculation section 205 calculates the operating quantity u(i) of the above-mentioned ISC valve 44 as the actuator on the basis of this calculated optimal feedback gain, the state variable quantities output from the above-mentioned state variable quantity control output section 201, and the difference accumulation value according to the above-mentioned speed difference accumulation section 202.

These devices constituting the electronic control unit 20 is designed using the following method so as to enable execution of idle speed control.

(1) Modeling (Identification) of Controlled Object

A general auto-regressive moving average model takes the form of the following equation.

[Equation 1]

$$Y(i)=A_1Y(i-1)+A_2Y(i-2)+\ldots+A_nY(i-n)+B_1U(i-1)+B_2U(i-2)+\ldots+B_mU(i-m) \quad (1)$$

In the apparatus of this embodiment, an auto-regressive moving average model of the order (2, 1) with n=2 and m=1 is employed, with delay p due to dead time taken as p=1, and consideration also given to disturbance d,

[Equation 2 ]

$$Ne(i)=a_1Ne(i-1)+a_2Ne(i-2)+b_1u(i-2)+d(i-1) \quad (2)$$

thereby approximating a model of a system controlling the idle speed of the engine 10. Here, a1, a2, and b1 are model constants of the approximated model, and u indicates the operating quantity of the ISC valve 44. This operating quantity u corresponds in this embodiment to the duty ratio of the pulse signals applied to the above-mentioned winding 48. Additionally, i is a variable indicating the number of times of execution of control from the start of initial sampling.

(2) Realtime Calculation (Applied Identification) of Model Constants a and b

Separating the above-mentioned equation (2) for known signals and unknown signals results in the following equation.

[Equation 3]

$$Ne(i) = (Ne(i-1), Ne(i-2), u(i-2), 1)\begin{pmatrix} a_1 \\ a_2 \\ b_1 \\ d \end{pmatrix} \quad (3)$$

Here, the unknown quantities a1, a2, b1 and d are determined successively by the method of least squares.

Briefly, taking Θ (THETA) as the parameter vector or W as the measurement value vector,

[Equation 4]

$$\hat{N}e(i) = W^T(i)\hat{\Theta}(i) \quad (4)$$
$$\hat{\Theta}(i) = [\hat{a}_1(i), \hat{a}_2(i), \hat{b}_1(i), \hat{d}(i)]^T$$
$$W(i) = [Ne(i-1), Ne(i-2), u(i-2), 1]^T$$

and so if

[Equation 5]

$$\hat{\Theta}(i) = \hat{\Theta}(i-1) + \frac{\Gamma(i-1)W(i)}{1 + W^T(i)\Gamma(i-1)W(i)}\{Ne(i) - W^T(i)\hat{\Theta}(i-1)\} \quad (5)$$

then under the condition that i→∞,

[Equation 6]

$$\hat{a}_1(i) \to a_1 \quad (6)$$
$$\hat{a}_2(i) \to a_2$$
$$\hat{b}_1(i) \to b_1$$
$$\hat{d}(i) \to d$$

is assured. For this reason, by employing the algorithm of the foregoing equation (5), the unknown quantities which are the model constants a and b (more precisely, a1, a2, b1, and d) are determined. Accordingly, the equation (5) is executed in realtime, and the values to be determined are taken for the sake of convenience to be the model constants determined here. However, in the equation (5), Γ (GAMMA) is:

[Equation 7]

$$\Gamma(i) = \Gamma(i-1) - \frac{\Gamma(i-1)W(i)W^T(i)\Gamma(i-1)}{1 + W^T(i)\Gamma(i-1)W(i)} \quad (7)$$

and is a symmetrical 4×4 matrix taking

[Equation8]

$$\Gamma(-1) = \begin{pmatrix} g_0 & 0 & 0 & 0 \\ 0 & g_0 & 0 & 0 \\ 0 & 0 & g_0 & 0 \\ 0 & 0 & 0 & g_0 \end{pmatrix} \quad (8)$$
$$g_0 > 0$$

as the initial value.

(3) Method of Representing State Variables X

When the above-mentioned equation (2) is used to express state variables by means of known signals, it is rewritten as the following equation.

[Equation 9]

$$\begin{pmatrix} X_1(i+1) \\ X_2(i+1) \\ X_3(i+1) \\ X_4(i+1) \end{pmatrix} = \begin{pmatrix} a_1 & a_2 & 0 & b_1 \\ 1 & 0 & 0 & 0 \\ 0 & 0 & 0 & 0 \\ 0 & 0 & 1 & 0 \end{pmatrix}\begin{pmatrix} X_1(i) \\ X_2(i) \\ X_3(i) \\ X_4(i) \end{pmatrix} + \quad (9)$$

-continued $$\begin{pmatrix} 0 \\ 0 \\ 1 \\ 0 \end{pmatrix} u(i) + \begin{pmatrix} 1 \\ 0 \\ 0 \\ 0 \end{pmatrix} d(i)$$

Here,

[Equation 10]

$$X_1(i) = Ne(i) \quad (10)$$
$$X_2(i) = Ne(1i-1)$$
$$X_3(i) = u(i-1)$$
$$X_4(i) = u(i-2)$$

and so

[Equation 11]

$$X(i) = [Ne(i), Ne(i-1), u(i-1), u(i-2)]^T \quad (11)$$

can be employed.

(4) Design of Regulator

A generally optimal regulator does not act to cause output to converge with the target value. Accordingly, in the present embodiment, the error of the target speed and the actual speed

[Equation 12]

$$e(i) = NT(i) - Ne(i) \quad (12)$$

is introduced to form a regulator of an expanded system. The aim is:

[Equation 13]

$$\lim_{i \to +\infty} e(i) \to 0 \quad (13)$$

Briefly, a system is designed so that Error e(i)=NT(i)−Ne(i) is made to converge to 0.

However, as is understood from

[Equation 14]

$$NT(i+1) = NT(i) \quad (14)$$

the foregoing target value is assumed to be unchanging.

Next, to form an expanded system such as this,

[Equation 15]

$$e(i+1) = NT(i+1) - Ne(i+1) \quad (15)$$

is rewritten to take q as a time-transition operator, yielding the following.

[Equation 16]

$$\begin{aligned} (1-q^{-1})e(i+1) &= (1-q^{-1})\{NT(i+1) - Ne(i+1)\} \quad (16) \\ &= -(1-q^{-1})Ne(i+1) \\ &= -a_1(1-q^{-1})Ne(i) \\ &\quad -a_2(1-q^{-1})Ne(i-1) \\ &\quad -b_1(1-q^{-1})u(i-2) \end{aligned}$$

Accordingly,

[Equation 17]

$$\begin{aligned} e(i+1) = e(i) &- a_1(1-q^{-1})Ne(i) \quad (17) \\ &- a_2(1-q^{-1})Ne(i-1) \\ &- b_1(1-q^{-1})u(i-2) \end{aligned}$$

Consequently, the following equations are given as state equations of the expanded system.

[Equation 18]

$$\begin{pmatrix} (1-q^{-1})Ne(i+1) \\ (1-q^{-1})Ne(i) \\ (1-q^{-1})u(i) \\ (1-q^{-1})u(i-1) \\ e(i+1) \end{pmatrix} = \begin{pmatrix} a_1 & a_2 & 0 & b_1 & 0 \\ 1 & 0 & 0 & 0 & 0 \\ 0 & 0 & 0 & 0 & 0 \\ 0 & 0 & 1 & 0 & 0 \\ -a_1 & -a_2 & 0 & -b_1 & 1 \end{pmatrix} \begin{pmatrix} (1-q^{-1})Ne(i) \\ (1-q^{-1})Ne(i-1) \\ (1-q^{-1})u(i-2) \\ (1-q^{-1})u(i-3) \\ e(i+1) \end{pmatrix} + \begin{pmatrix} 0 \\ 0 \\ 1 \\ 0 \\ 0 \end{pmatrix} (1-q^{-1})u(i) \quad (18)$$

[Equation 19]

$$y(i) = (0 \quad 0 \quad 0 \quad 0 \quad 1) \begin{pmatrix} (1-q^{-1})Ne(i) \\ (1-q^{-1})Ne(i-1) \\ (1-q^{-1})u(i-2) \\ (1-q^{-1})u(i-3) \\ e(i+1) \end{pmatrix} \quad (19)$$

Hereinafter, the following definitions are made for the sake of convenience.

[Equation 20]

$$A = \begin{pmatrix} a_1 & a_2 & 0 & b_2 & 0 \\ 1 & 0 & 0 & 0 & 0 \\ 0 & 0 & 0 & 0 & 0 \\ 0 & 0 & 1 & 0 & 0 \\ -a_1 & -a_2 & 0 & -b_1 & 1 \end{pmatrix} \quad (20)$$

[Equation 21]

$$B = \begin{pmatrix} 0 \\ 0 \\ 1 \\ 0 \\ 0 \end{pmatrix} \quad (21)$$

(5) Design of Optimal Regulator

When state feedback is performed regarding the foregoing equations (18) and (19), the following results.

[Equation 22]

$$(1-q^{-1})u(i) = (1-q^{-1})\{K_1Ne(i) + K_2Ne(i-1) + K_3u(i-1) + K_4u(i-2)\} + K_5e(i) \quad (22)$$

Accordingly, the following results.

[Equation 23]

$$u(i) = K_1Ne(i) + K_2Ne(i-1) + K_3u(i-1) + K_4u(i-2) + DI(i) \quad (23)$$

Here, DI(i) is:

[Equation 24]

$$DI(i) = DI(i-1) + K_5\{NT(i) - Ne(i)\} \quad (24)$$

and is the accumulation value of the difference of the target speed and the actual speed.

Next, to obtain the optimal regulator from these equations (23) and (24), the following evaluation function is employed,

[Equation 25]

$$J = \sum_{i=0}^{\infty} \{q_1(NT - Ne(i))^2 + r(u(i) - u(i-1))^2\} \quad (25)$$

thereby determining the optimal feedback gain so that J of the equation (25) is minimized.

Here, it is understood that the feedback gain K which minimizes J of the equation (25) is determined as follows.

[Equation 26]

$$K^T = -(r + P_{33})^{-1} B^T PA \quad (26)$$

However, P in this equation (26) is the solution of the following Riccaci's equation.

[Equation 27]

$$P = \begin{pmatrix} 0 & 0 & 0 & 0 & 0 \\ 0 & 0 & 0 & 0 & 0 \\ 0 & 0 & 0 & 0 & 0 \\ 0 & 0 & 0 & 0 & 0 \\ 0 & 0 & 0 & 0 & q_1 \end{pmatrix} + A^TPA - A^TPB(\tau + B^TPB)^{-1} B^TPA \quad (27)$$

Furthermore, P33 in the same equation (26) represents the central element P33 in the following.

[Equation 28]

$$P = \begin{pmatrix} P_{11} & P_{12} & P_{13} & P_{14} & P_{15} \\ P_{12} & P_{22} & P_{23} & P_{24} & P_{25} \\ P_{13} & P_{23} & P_{33} & P_{34} & P_{35} \\ P_{14} & P_{24} & P_{34} & P_{44} & P_{45} \\ P_{15} & P_{25} & P_{35} & P_{45} & P_{55} \end{pmatrix} \quad (28)$$

Hereinafter, the following definition is made for the sake of convenience.

[Equaiton 29]

$$Q = \begin{pmatrix} 0 & 0 & 0 & 0 & 0 \\ 0 & 0 & 0 & 0 & 0 \\ 0 & 0 & 0 & 0 & 0 \\ 0 & 0 & 0 & 0 & 0 \\ 0 & 0 & 0 & 0 & q_1 \end{pmatrix} \quad (29)$$

As an incidental comment, the evaluation function in the foregoing equation (25), or the q1 and r in the foregoing equations (26), (27), and (29), are respectively weight coefficients, and making q1 larger signifies emphasizing the target value and performing a comparatively large actuator operation so as to approach it, whereas making r larger conversely signifies restricting the movement of the operating quantity.

(6) Realtime Calculation of Feedback Gain

In order to determine the above-mentioned feedback gain K, it is first necessary to determine the value of the foregoing P. Accordingly, the following is performed.

[Equation 30]

$$P(j+1)=Q+A^T\{P(j)-(r+P_{33}(j))^{-1}P(j)BB^TP(j)\}A \quad (30)$$

At this time, $j\rightarrow\infty$, and P (j) becomes a unique value. This is known as the positive solution of Riccaci's equation.

Consequently, the unique value of P is determined by giving the above-mentioned weight coefficients q1 and r along with the above-mentioned model constants a1, a2, and b1 calculated in realtime in the equation (30), and repeatedly executing calculation of the equation (30) until P (j) converges. When this value of P is determined, then by substituting this in the equation (26), the optimal feedback gain such that the evaluation function of the equation (25) is minimized is determined.

Moreover, when calculating P according to the foregoing equation (30), then if there is a value of P converged in a previous calculation, this is taken as follows,

[Equation 31]

$$P(0)=P_0 \quad (31)$$

and is carried over to the time of the next calculation. By means of this, the operational efficiency of the equation (30) can be vastly improved.

Additionally, in practical application, it is sufficient that such calculation of feedback gain be performed with fluctuation of the dynamic model of the engine taken as the controlled object as a condition, and this need not necessarily be performed in realtime. In this sense, the affix indicating the number of times of execution of control in the equation (30) is changed from (i) to (j).

The foregoing has been a description of modeling of a controlled object (realtime identification of model constants), a method of representing a state variable quantity, design of a regulator, and design of an optimal regulator (determination of optimal feedback gain), but of these elements, with the control apparatus of the present embodiment, the electronic control unit 20 indicated in FIG. 2 executes modeling of the controlled object (realtime identification of model constants) as well as design of an optimal regulator (determination of optimal feedback gain).

Figure 3:
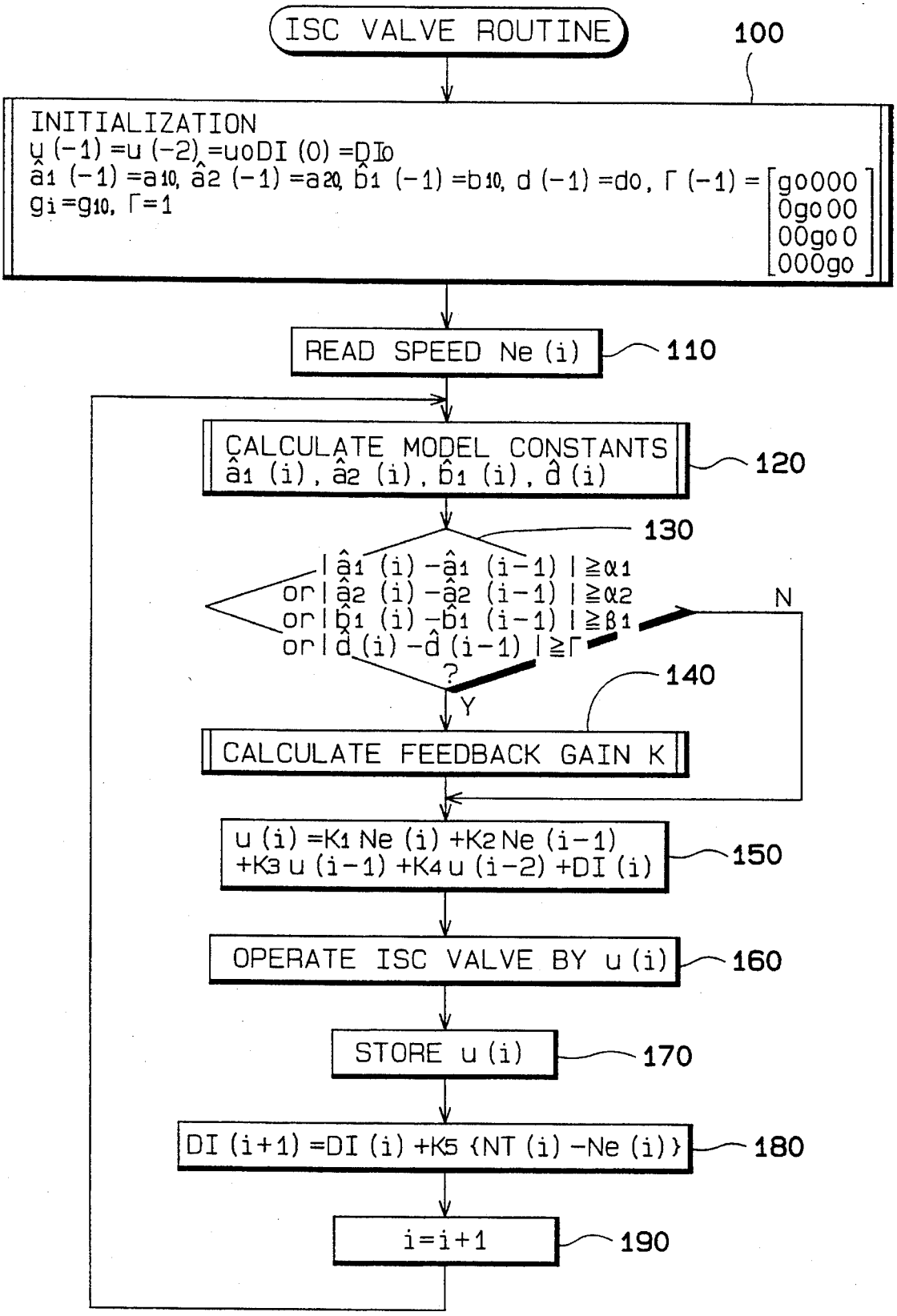
FIG. 3 is a flowchart of the procedure operating an ISC valve depicted in FIG. 1 or FIG. 2 as an example of operation of an apparatus of the embodiment.
Figure 4:
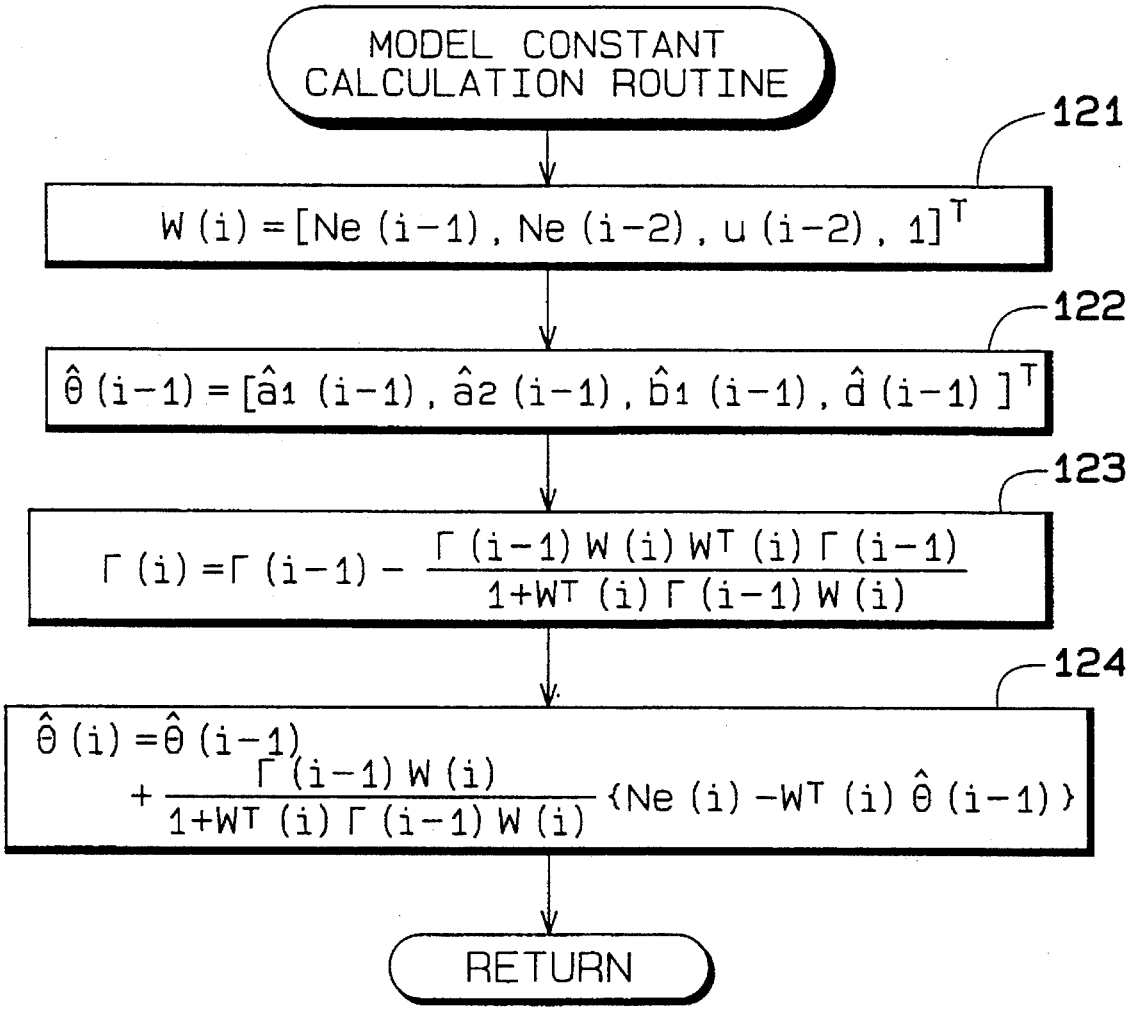
FIG. 4 is a flowchart of the model constant calculation procedure executed by the constant calculation section shown in FIG. 2.
Figure 5:
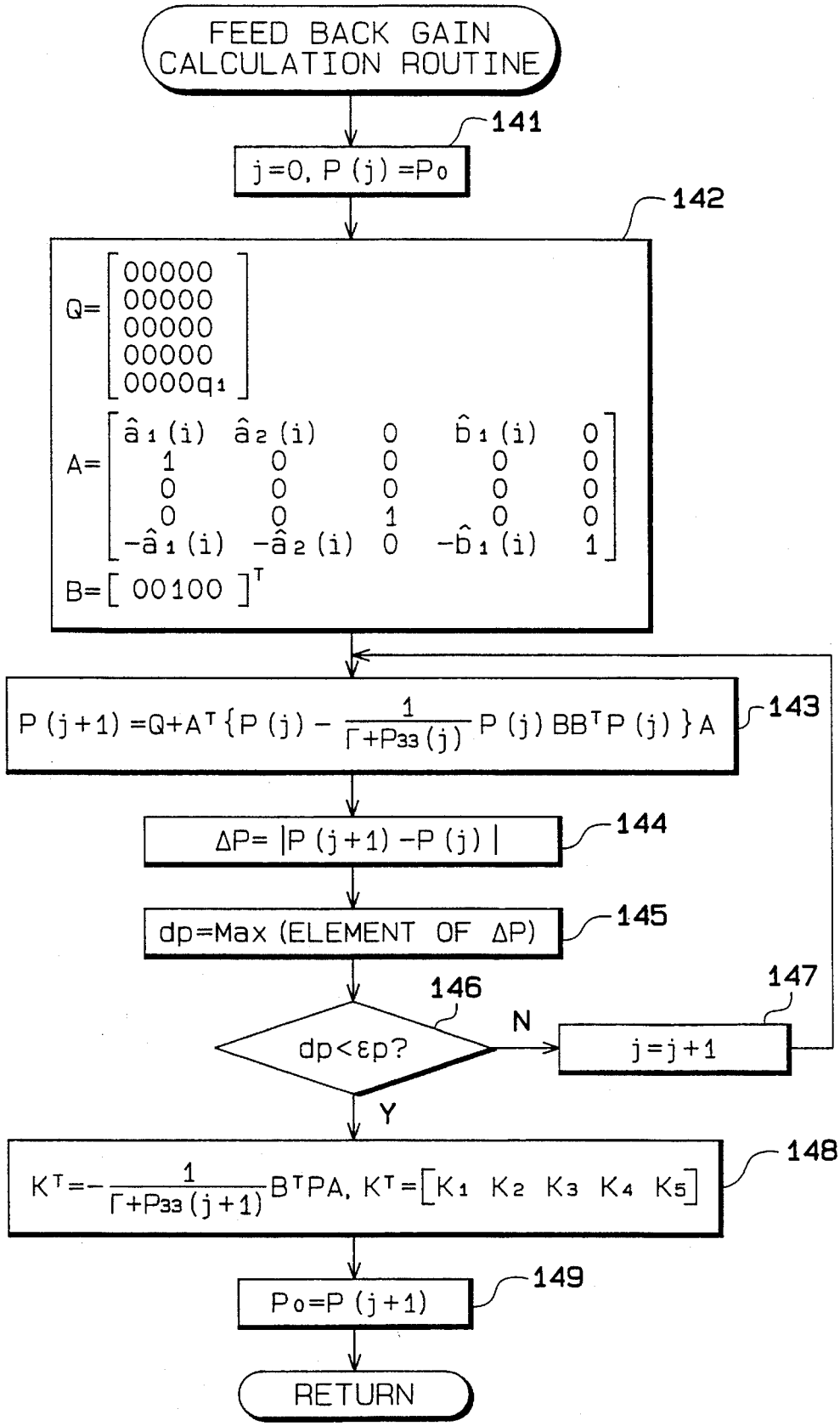
FIG. 5 is a flowchart of the feedback gain constant calculation procedure executed by the feedback gain calculation section shown in FIG. 2.

FIGS. 3 to 5 indicate the processing procedure for the processing actually conducted when this electronic control unit 20 controls the idle speed of the engine 10. The operation of a control apparatus of the present embodiment will be described in further detail herebelow with reference to FIGS. 3 to 5.

FIG. 3 is a flowchart for a control apparatus of the present embodiment, indicating the operation routine of the ISC valve which is executed when the electronic control unit 20 controls the above-mentioned idle speed.

The electronic control unit 20 executes the program indicated in FIG. 3 when the power supply is switched on. Immediately after startup, what is known as initialization processing is performed (step 100). Here, initialization processing refers, for example, to processing for a specified area of the RAM 53 wherein a variable i representing the number of times of sampling is set equal to 0, and the operating quantity of the idle air amount, the compensation quantity, the estimated quantities of the model constants, the above-mentioned symmetrical matrix Γ (GAMMA), and so on are set to their respective initial values. Additionally, in this embodiment, the weight coefficient q1 in the foregoing evaluation function (equation (25)) is initialized to its initial value of q10, and the other weight coefficient r is initialized to "1."

Next, after the electronic control unit 20 reads the actual idle speed Ne(i) output from the engine speed sensor 30 via the input port 56 (step 110), the realtime calculation of the model constants (applied identification) described above begins (step 120). This model constant calculation routine is shown in FIG. 4.

Briefly, when performing this model constant calculation, the electronic control unit 20 first determines the measurement value vector and parameter vector according to the foregoing equation (4) (steps 121 and 122), introduces the 4× 4 symmetrical matrix Γ (GAMMA) represented in the foregoing equations (7) and (8) (step 123), then executes the foregoing equation (5) (step 124). The model constants a1, a2, b1, and disturbance d obtained as a result of this are then returned to the operation routine of the ISC valve indicated in FIG. 3.

Having determined the model constants in this manner, then in the operation routine of the ISC valve, the electronic control unit 20 determines the respective differences between the determined constants and the constants determined in the previous processing, and compares these differences with the arbitrary constants α1, (step 130). This processing is done in order to decide whether a fluctuation has been induced in the engine 10 taken as the controlled object. Employed as these arbitrary constants α1, α2, β1 and γ are boundary values based on experience which allow employment of the identical feedback gain with no particular problem in terms of control as the optimal feedback gain described above, even if a fluctuation has been induced in the controlled object. Because of this, if the decision "NO" is made in the comparison processing of the step 130, it means that a fluctuation which necessitates a change in the optimal feedback gain has not yet been induced in the foregoing adaptively-identified controlled object. Conversely, if the decision "YES" is made, it means that a fluctuation which is sufficiently large to necessitate a change in the optimal feedback gain has been induced in the adaptively-identified controlled object.

Accordingly, in the above-mentioned comparison processing in the step 130, the electronic control unit 20 recalculates the feedback gain K only in the case when the decision "YES" is made (step 140). The feedback gain calculation routine is shown in FIG. 5.

When performing this feedback gain calculation, the electronic control unit 20 first initializes the number of times of execution of control j and the above-mentioned symmetrical matrix P (step 141), then, on the basis of the definitions of "Q," "A", and "B" according to the foregoing equations (29), (20), and (21) (step 142), executes processing to determine the value P on the basis of the above-mentioned equation (30) (step 143). Here, in short, the differences of all 5×5 elements forming the symmetrical matrix P are determined (step 144), and the largest difference thereof is extracted as dp (step 145). When this largest difference dp has become smaller than a specified value εp, the convergence of the value of P is completed and the above-mentioned unique P is understood to have been determined (step 146), and until that time the processing of these steps 143 to 146 is repeated while incrementing the number of times of execution of control j (step 147). When the above-mentioned unique P is obtained, it is substituted in the foregoing equation (26) to determine the optimal feedback gain K (step 148), then processing is performed to take the value of the above-mentioned P which has been obtained as the next initial value (step 149), and this determined feedback gain K (K1, K2, K3, K4, and K5) is returned to the ISC valve operation routine shown in FIG. 3.

In the ISC valve operation routine shown in FIG. 3, the electronic control unit 20 then executes the foregoing equation (23), employing this optimal feedback gain K (K1, K2, K3, K4, and K5) which has been determined or which has been set at that time, and performs processing to determine the operating quantity of the ISC valve 44 (step 150).

When the electronic control unit 20 determines the operating quantity in this manner, this determined operating quantity u(i) is employed to operate the ISC valve 44 (step 160), and furthermore processing is performed to store or update this operating quantity u(i) in a specified area of the RAM 53 as u(i−1) in preparation for the next execution of processing (step 170).

Finally, the electronic control unit 20 determines and accumulates the difference between the target engine speed NT(i) and the actual idle speed Ne (i) on the basis of the foregoing equation (24) (step 180), then, after incrementing by 1 the value of the variable i of the above-mentioned number of times of execution of control (step 190), returns to the step 120 and reiterates processing for the foregoing steps 120 to 190.

In this manner, according to the control apparatus of this embodiment, modeling of the controlled object is performed in realtime in order to control the idle speed of the engine 10, and moreover, the model constant is employed to calculate the optimal feedback gain; accordingly, even if some fluctuation should occur in the engine 10 approximated as this dynamic model, the effect of error it exerts on the control result is naturally suppressed. Because of this, constantly stabilized control which conforms with the periodic state of the engine 10 is maintained for the speed control during idling.

Furthermore, as is shown in FIG. 3 (particularly the step 130), the control apparatus of the present embodiment is structured so as to determine the presence or absence of fluctuation in the controlled object and recalculate the feedback gain only after the amount of fluctuation has surpassed a specified quantity, and so is undoubtedly superior in terms of processing efficiency, but is not exclusively restricted to such a structure. That is to say, for the sake of convenience, a structure may be adopted whereby the processing of the foregoing step 130 is omitted and the calculation of the feedback gain is also performed in realtime.

Additionally, even if determination of the presence or absence of fluctuation in the controlled object and recalculation of the feedback gain are performed, realization under a variety of other circumstances is possible. For example, a structure which takes from among the model constants which are determined only a specific single constant or a specific plurality of constants as a monitored object or monitored objects for the purpose of determining the presence or absence fluctuation in the controlled object may be taken. Further, a structure which, with regard to all or an arbitrary plurality of constants from among the model constants which are determined, determined whether fluctuation has been induced in the controlled object on the basis of a logical product condition wherein the fluctuation quantities exceed the foregoing arbitrary constants may be taken. Additionally, the above-mentioned embodiment indicates a case whereby the control apparatus according to the present invention is applied to a device for controlling the speed of an engine during idling, but needless to say the control apparatus is not exclusively an idle speed control apparatus of this type. That is to say, according to the control apparatus of an internal combustion engine of the present invention, stabilized control can be maintained even in a case wherein this may, for example, be applied to a device for regulating the air-fuel ratio of an engine.

Next, as another embodiment of the control apparatus of the present invention, a specific embodiment will be described for such a device for regulating the air-fuel ratio of the engine.

Figure 6:
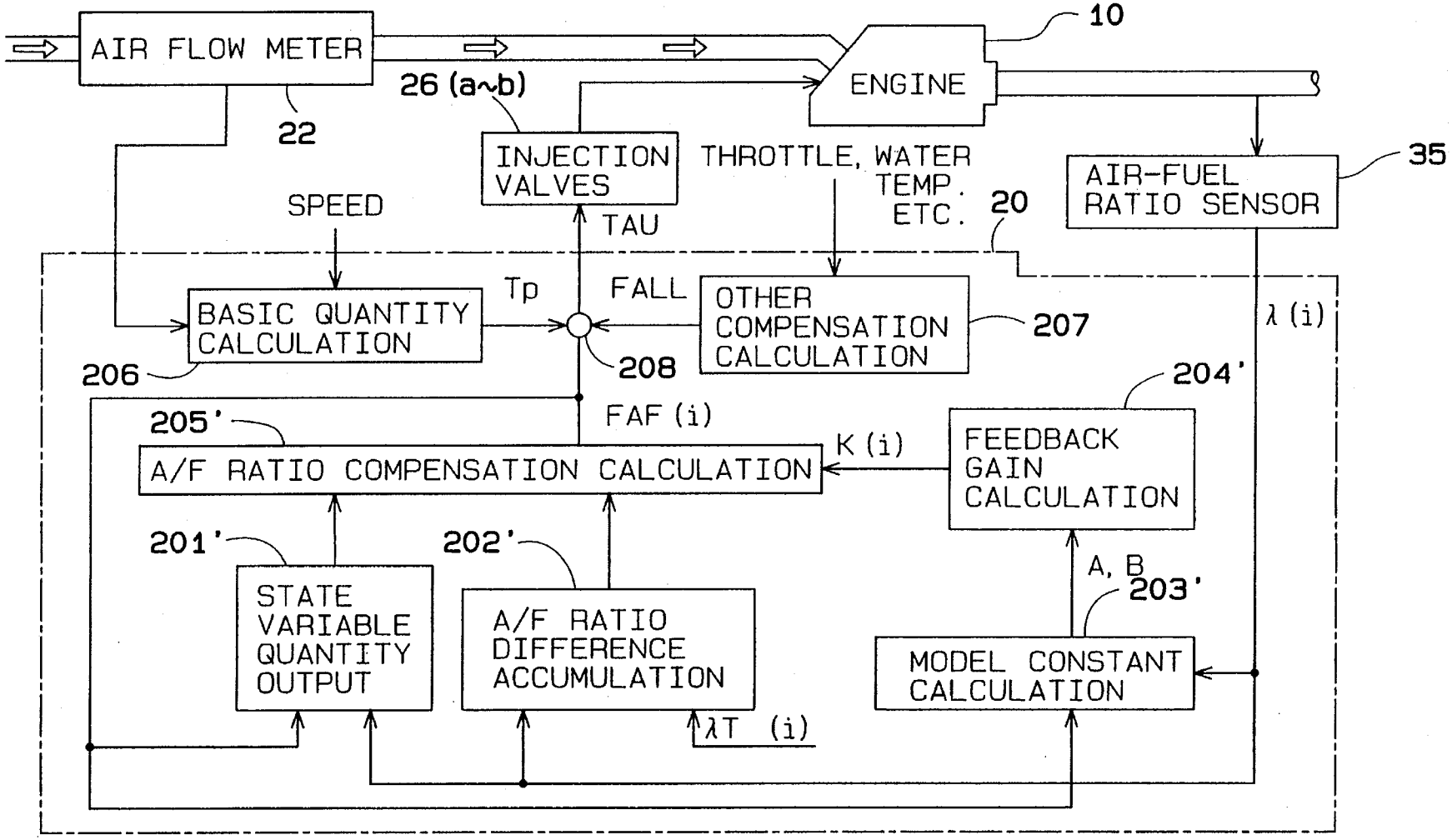
FIG. 6 is a block diagram of the functions and connections between functions in the case of control for air-fuel ratio by an apparatus, and primarily the electronic control unit, of another embodiment of a control apparatus for an internal combustion engine according to another embodiment of this invention.

In this device for regulating the air-fuel ratio of the engine, the model shown in FIG. 6 takes the rate of fuel supply as the operating quantity (control input), and following the combustion thereof, takes the air-fuel ratio in the exhaust gas as the control quantity (control output), and models the above-mentioned engine 10. The control states as a device for performing the foregoing air-fuel ratio control for the engine 10 will be described in detail herebelow. The structure of the apparatus of this embodiment as well is basically identical to the engine and the electronic control unit shown in FIG. 1.

In FIG. 6, a state variable quantity control output section 201' forming the electronic control unit 20 outputs present and past operating quantities according to the above-mentioned fuel injection valves 26 (**26*a* to 26*d*) as an actuator (the fuel injection quantity; however, in consideration of the feedback efficiency of the control apparatus, the present and past values of the air-fuel ratio compensation coefficient FAF, an element thereof, are substituted), as well as the present and past control quantity values detected by the above-mentioned air-fuel ratio sensor 35 as a running state detection means, as a state variable quantity representing the internal state of the dynamic model of the engine 10. Similarly, an air-fuel ratio difference accumulation section 202' accumulates the difference between the control quantity value λ(i) detected by the above-mentioned air-fuel ratio sensor 35 and its target value λT(i). Also similarly, a model constant calculation section 203' calculates the model constant in realtime as the dynamic model of the engine on the basis of the past operating quantity of the above-mentioned fuel injection valves 26 (the fuel injection quantity, similarly, however, the past value of the air-fuel ratio compensation coefficient FAF is substituted) as well as the present and past control quantity values detected by the above-mentioned air-fuel ratio sensor 35. The feedback gain calculation section 204' employs a specified evaluation function to calculate the optimal feedback gain for a regulator constructed on the basis of this calculated model constant. Additionally, an air-fuel ratio compensation coefficient calculation section 205' calculates the above-mentioned air-fuel ratio compensation coefficient FAF(i) as, in short, an element of the above-mentioned fuel injection valves 26 as the actuator on the basis of this calculated optimal feedback gain, the state variable quantities output from the above-mentioned state variable quantity control output section 201' and the difference accumulation value according to the above-mentioned air-fuel ratio difference accumulation section 202'**.

Additionally, within the electronic control unit 20, the basic fuel injection quantity calculation section 206 calculates the basic fuel injection quantity Tp of the fuel according to the foregoing fuel injection valves 26 on the basis of the air quantity Qa of the intake air detected by the above-mentioned air flow meter 22 (in the case of L-J type) or the air pressure Pm (in the case of D-J type) and the engine speed Ne of the engine 10 detected by the above-mentioned engine speed sensor 30, and the other compensation quantity calculation section 207 calculates all other compensation quantities FALL for the fuel injection quantity of the fuel according to the fuel injection valves 26 on the basis of detected values according to the above-mentioned throttle sensor 32, the coolant temperature sensor 33 and so on. In this connection, in the case where the air flow meter 22 is of L-J type, the foregoing basic fuel injection quantity Tp is determined as the following, with the compensation coefficient understood to be K:

[Equation 32]

$$Tp = K\frac{Qa}{Ne} \tag{32}$$

In the case where the air flow meter 22 is of D-J type, the foregoing basic fuel injection quantity Tp is normally priorly mapped according to experimentation as a value corresponding respectively to the foregoing engine speed Ne and air pressure Pm, and the value corresponding to the engine speed Ne and air pressure Pm at any given time is read from the map as the basic fuel injection quantity Tp at that time. Additionally, compensation to inject and supply more fuel to the engine during acceleration of the vehicle provided with the engine 10 or when the engine 10 is cold exists as a compensation based on the compensation quantity FALL which is calculated by the foregoing other compensation quantity arithmetic section 207. This acceleration of the vehicle and temperature of the engine 10 are detected respectively by the foregoing throttle sensor 32, coolant temperature sensor 33, and so on. A multiplier 208 multiplies the basic fuel injection quantity Tp and all other compensation quantities FALL which are calculated with the fuel injection compensation coefficient FAF calculated according to the foregoing air-fuel ratio compensation coefficient calculation section 205' and determines the periodic operating quantity of the fuel injection valves 26 or, in other words, the fuel injection quantity TAU according to the fuel injection valves 26; here the operating quantity for the fuel injection valves 26 which are the actuator, i.e., the fuel injection quantity TAU, is taken as the following:

[Equation 33]

$$TAU = FAF \times Tp \times FALL \tag{33}$$

and is given through the electronic control unit 20.

These respective sections which form the electronic control unit 20 (primarily the state variable quantity control output section 201', air-fuel ratio difference accumulation section 202', model constant calculation section 203', feedback gain calculation section 204' and air-fuel ratio compensation coefficient calculation section 205') are priorly designed according to the following method so as to execute the air-fuel ratio control herein.

(1) Modeling (Identification) of Controlled Object

In the apparatus of this embodiment, the auto-regressive moving average model of the foregoing equation (1) is employed, with delay p due to dead time taken as p=3, and consideration also given to disturbance c,

[Equation 34]

$$\lambda(i) = a\lambda(i-1) + bFAF(i-4) + c \tag{34}$$

thereby approximating a model of a system controlling the air-fuel ratio of the engine 10. Here, a and b are model constants of the approximated model, and FAF represents the air-fuel ratio compensation coefficient described above. Although the air-fuel ratio λ which serves as the controlled object in this embodiment is accompanied by the foregoing dead time and a primary delay, its correlation with the air-fuel ratio compensation coefficient FAF is strong, and because it accurately tracks the movement (value) of the air-fuel ratio compensation coefficient FAF, substitution as (a−1) is possible for the foregoing model constant b. Accordingly, to further simplify subsequent calculation, (a−1) is actively adopted to substitute for the model constant b. That is to say, this is also treated as the following in the model equation, which is the foregoing equation (34).

[Equation 35]

$$\lambda(i)a\lambda(i-1) + (a-1)FAF(i-4) + c \tag{35}$$

(2) Realtime Calculation (Adaptive Identification) of Model Constants a and b

Separating the above-mentioned equation (35) for known signals and unknown signals results in the following equation.

[Equation 36]

$$\lambda(i) = (\lambda(i-1) + FAF(i-4), 1)\begin{pmatrix} a \\ c \end{pmatrix} - FAF(i-4) \tag{36}$$

Here, in order to transpose the second term of the right side of the equation (36) and further simplify the content of the first term of the right side of the equation, the equation is respectively rewritten as follows.

[Equation 37]

$$\lambda(i) + FAF(i-4) \Rightarrow Y(i) \tag{37}$$

$$\lambda(i-1) + FAF(i-4) \Rightarrow U(i-1)$$

The foregoing equation (36) thus becomes the following.

[Equation 38]

$$Y(i) = (U(i-1), 1)\begin{pmatrix} a \\ c \end{pmatrix} \tag{38}$$

Here as well, the unknown quantities a and c are determined successively by the method of least squares.

Briefly, taking Θ as the parameter vector or W as the measurement value vector,

[Equation 39]

$$\hat{y}(i) = W^T(i)\hat{\Theta}(i)$$
$$\hat{\Theta}(i) = [\hat{a}(i), \hat{c}(i)]^T$$
$$W(i) = [U(i-1), 1]^T$$

and so if

[Equation 40]

$$\hat{\Theta}(i) = \hat{\Theta}(i-1) + \frac{\Gamma(i-1)W(i)}{1 + W^T(i)\Gamma(i-1)W(i)}\{Y(i) - W^T(i)\hat{\Theta}(i-1)\} \tag{40}$$

then under the condition that $i \to \infty$,

[Equation 41]

$$\hat{a}(i) \to a \tag{41}$$
$$\hat{c}(i) \to c$$

is assured. For this reason, by employing the algorithm of the foregoing equation (40), the unknown quantities which are the model constants a and c are determined. Accordingly, here as well the equation (40) is executed in realtime, and the values to be determined are taken for the sake of convenience to be the model constants determined here. However, in the equation (40), Γ (GAMMA) is:

[Equation 42]

$$\Gamma(i) = \Gamma(i-1) - \frac{\Gamma(i-1)W(i)W^T(i)\Gamma(i-1)}{1 + W^T(i)\Gamma(i-1)W(i)} \tag{42}$$

and is a symmetrical 2×2 matrix taking

[Equation 43]

$$\Gamma(i-1)=\begin{pmatrix} g_0 & 0 \\ 0 & g_0 \end{pmatrix} \quad (43)$$

$$g_0 > 0$$

as the initial value.

(3) Method of Representing State Variables X

When the above-mentioned equation (35) is used to express state variables by means of known signals, it is rewritten as the following equation.

[Equation 44]

$$\begin{pmatrix} X_1(i+1) \\ X_2(i+1) \\ X_3(i+1) \\ X_4(i+1) \end{pmatrix} = \begin{pmatrix} a & 0 & 0 & a-1 \\ 0 & 0 & 0 & 0 \\ 0 & 1 & 0 & 0 \\ 0 & 0 & 1 & 0 \end{pmatrix} \begin{pmatrix} X_1(i) \\ X_2(i) \\ X_3(i) \\ X_4(i) \end{pmatrix} + \begin{pmatrix} 0 \\ 1 \\ 0 \\ 0 \end{pmatrix} FAF(i) + \begin{pmatrix} c \\ 0 \\ 0 \\ 0 \end{pmatrix} \quad (44)$$

Here,

[Equation 45]

$$\begin{aligned} X_1(i) &= \lambda(i) \\ X_2(i) &= FAF(i-1) \\ X_3(i) &= FAF(i-2) \\ X_4(i) &= FAF(i-3) \end{aligned} \quad (45)$$

and so

[Equation 46]

$$X(i) = [\lambda(i), FAF(i-1), FAF(i-2), FAF(i-3)]^T \quad (46)$$

can be employed.

(4) Design of Regulator

As has been described previously, a generally optimal regulator does not act to cause output to converge with the target value. Accordingly, in the present embodiment as well, the error of the target air-fuel ratio and the actual air-fuel ratio

[Equation 47]

$$e(i)=\lambda T(i)-\lambda(i) \quad (47)$$

is introduced to form a regulator of an expanded system. The aim is:

[Equation 48]

$$\lim_{i\to\infty} e(i)\to 0 \quad (48)$$

Briefly, the system is designed so that Error e(i)=λT(i)−λ(i) is made to converge to 0. However, as is understood from

[Equation 49]

$$\lambda T(i+1)=\lambda T(i) \quad (49)$$

the target value λT is assumed to be unchanging.

Next, to form an expanded system such as this,

[Equation 50]

$$e(i+1)=\lambda T(i=1)-\lambda(i+1) \quad (50)$$

is rewritten to take q as a time-transition operator, yielding the following.

[Equation 51]

$$\begin{aligned} (1-q^{-1})e(i+1) &= (1-q^{-1})\{\lambda T(i+1)-\lambda(i+1)\} \\ &= -(1-q^{-1})\lambda(i+1) \\ &= -a(1-q^{-1})\lambda(i) \\ &\quad -(a-1)(1-q^{-1})FAF(i-3) \end{aligned} \quad (51)$$

Accordingly,

[Equation 52]

$$\begin{aligned} e(i+1)=e(i) &\quad -a(1-q^{-1})\lambda(i) \\ &\quad -(a-1)(1-q^{-1})FAF(i-3) \end{aligned} \quad (52)$$

Consequently, the following equations is given as state equation of the expanded system.

[Equation 53]

$$\begin{pmatrix} (1-q^{-1})\lambda(i+1) \\ (1-q^{-1})FAF(i) \\ (1-q^{-1})FAF(i-1) \\ (1-q^{-1})FAF(i-2) \\ e(i+1) \end{pmatrix} = \begin{pmatrix} a & 0 & 0 & a-1 & 0 \\ 0 & 0 & 0 & 0 & 0 \\ 0 & 1 & 0 & 0 & 0 \\ 0 & 0 & 1 & 0 & 0 \\ -a & 0 & 0 & -a+1 & 1 \end{pmatrix} \begin{pmatrix} (1-q^{-1})\lambda(i) \\ (1-q^{-1})FAF(i-1) \\ (1-q^{-1})FAF(i-2) \\ (1-q^{-1})FAF(i-3) \\ e(i) \end{pmatrix} + \begin{pmatrix} 0 \\ 1 \\ 0 \\ 0 \\ 0 \end{pmatrix} (1-q^{-1})FAF(i) \quad (53)$$

[Equation 54]

$$y(i) = (0 \quad 0 \quad 0 \quad 0 \quad 1) \begin{pmatrix} (1-q^{-1})\lambda(i) \\ (1-q^{-1})FAF(i-1) \\ (1-q^{-1})FAF(i-2) \\ (1-q^{-1})FAF(i-3) \\ e(i) \end{pmatrix} \quad (54)$$

Hereinafter as well, the following definitions are made for the sake of convenience.

[Equation 55]

$$A = \begin{pmatrix} a & 0 & 0 & a-1 & 0 \\ 0 & 0 & 0 & 0 & 0 \\ 0 & 1 & 0 & 0 & 0 \\ 0 & 0 & 1 & 0 & 0 \\ -a & 0 & 0 & -a+1 & 1 \end{pmatrix} \quad (55)$$

[Equation 56]

$$B = \begin{pmatrix} 0 \\ 1 \\ 0 \\ 0 \\ 0 \end{pmatrix} \quad (56)$$

(5) Design of Optimal Regulator

When state feedback is performed for foregoing equations (53) and (54), the following results.

[Equaiton 57]

$$(1-q^{-1})FAF(i) = (1-q^{-1})\{K_1\lambda(i)+K_2FAF(i-1)+K_3FAF(i-2)+K_4FAF(i-3)\}+K_e e(i) \quad (57)$$

Accordingly, the following results.

[Equation 58]

$$FAF(1i) = K_1\lambda(i)+K_2FAF(i-1)+K_3FAF(i-2)+K_4FAF(i-3)+ZI(i) \quad (58)$$

Here, ZI (i) is:

[Equation 59]

$$ZI(i)=ZI(i-1)+K_5\{\lambda T(i)-\lambda(i)\} \quad (59)$$

and is the accumulation value of the difference of the target air-fuel ratio and the actual air-fuel ratio.

Next, to obtain the optimal regulator from these equations (58) and (59), the following evaluation function is employed,

[Equation 60]

$$J=\sum_{i=0}^{\infty}\{q_1(\lambda T-\lambda(i))^2+\tau(FAF(i)-FAF(i-1))^2\} \quad (60)$$

thereby determining the optimal feedback gain so that J of the equation (60) is minimized.

Here, it is understood that the feedback gain K which minimizes J of the equation (60) is determined as follows.

[Equation 61]

$$K^T=-(r+P_{22})^{-1}B^TPA \quad (61)$$

However, P in this equation (61) is the solution of the following Riccaci's equation.

[Equation 62]

$$P=\begin{pmatrix}0&0&0&0&0\\0&0&0&0&0\\0&0&0&0&0\\0&0&0&0&0\\0&0&0&0&q_1\end{pmatrix}+A^TPA-A^TPB(\tau+B^TPB)^{-1}B^TPA \quad (62)$$

Furthermore, P22 in the same equation (61)

[Equation 63]

$$P=\begin{pmatrix}P_{11}&P_{12}&P_{13}&P_{14}&P_{15}\\P_{12}&P_{22}&P_{23}&P_{24}&P_{25}\\P_{13}&P_{23}&P_{33}&P_{34}&P_{35}\\P_{14}&P_{24}&P_{34}&P_{44}&P_{45}\\P_{15}&P_{25}&P_{35}&P_{45}&P_{55}\end{pmatrix} \quad (63)$$

represents the element P22 corresponding to the matrix B in the foregoing equation (56).

Hereinafter as well, the following definition is made for the sake of convenience.

[Equation 64]

$$Q=\begin{pmatrix}0&0&0&0&0\\0&0&0&0&0\\0&0&0&0&0\\0&0&0&0&0\\0&0&0&0&q_1\end{pmatrix} \quad (64)$$

Additionally, the evaluation function in the foregoing equation (60), or the q1 and r in the foregoing equations (61), (62) and (64), are respectively weight coefficients, and making q1 larger signifies emphasizing the target value and performing a comparatively large actuator operation so as to approach it, whereas making r larger conversely signifies restricting the movement of the operating quantity.

(6) Realtime Calculation of Feedback Gain

In order to determine the above-mentioned feedback gain K, it is first necessary to determine the value of the foregoing P. Accordingly, the following is performed.

[Equation 65]

$$P(j+1)=Q+A^T\{P(j)-(r+P_{22}(j))^{-1}P(j)BB^TP(j)\}A \quad (65)$$

At this time, $j\rightarrow\infty$, and P (j) becomes a unique value. This is known as the positive solution of Riccaci's equation.

Consequently, the unique value of P is determined by giving the above-mentioned weight coefficients q1 and r along with the above-mentioned model constants a and c calculated in realtime in the equation (65), and repeatedly executing calculation of the equation (65) until P (j) converges. When this value of P is determined, then by substituting this in the equation (61), the optimal feedback gain such that the evaluation function of the equation (60) is minimized is determined.

Moreover, when calculating P according to the foregoing equation (65), then if there is a value of P converged in a previous calculation, this is taken as follows,

[Equation 66]

$$P(0)-P_0 \quad (66)$$

and is carried over to the time of the next calculation. By means of this, the operational efficiency of the equation (65) can be vastly improved.

Additionally, in practical application, it is sufficient that such calculation of feedback gain be performed with fluctuation of the dynamic model of the engine taken as the controlled object as a condition, and this need not necessarily be performed in realtime. In this sense, the affix indicating the number of times of execution of control in the equation (65) is changed from (i) to (j).

The foregoing has been a description of modeling of a controlled object (realtime identification of model constants), a method of representing a state variable quantity, design of a regulator, and design of an optimal regulator (determination of optimal feedback gain), but of these elements, with the control apparatus of the present embodiment, the electronic control unit 20 indicated in the previous FIG. 6 executes modeling of the controlled object (realtime identification of model constants) as well as design of an optimal regulator (determination of optimal feedback gain).

FIGS. 7 to 10 indicate the processing procedure for the processing actually conducted when this electronic control unit 20 controls the air-fuel ratio of the engine 10. The operation of a control apparatus of the present embodiment will be described in further detail herebelow with reference to FIGS. 7 to 10.

Figure 7:
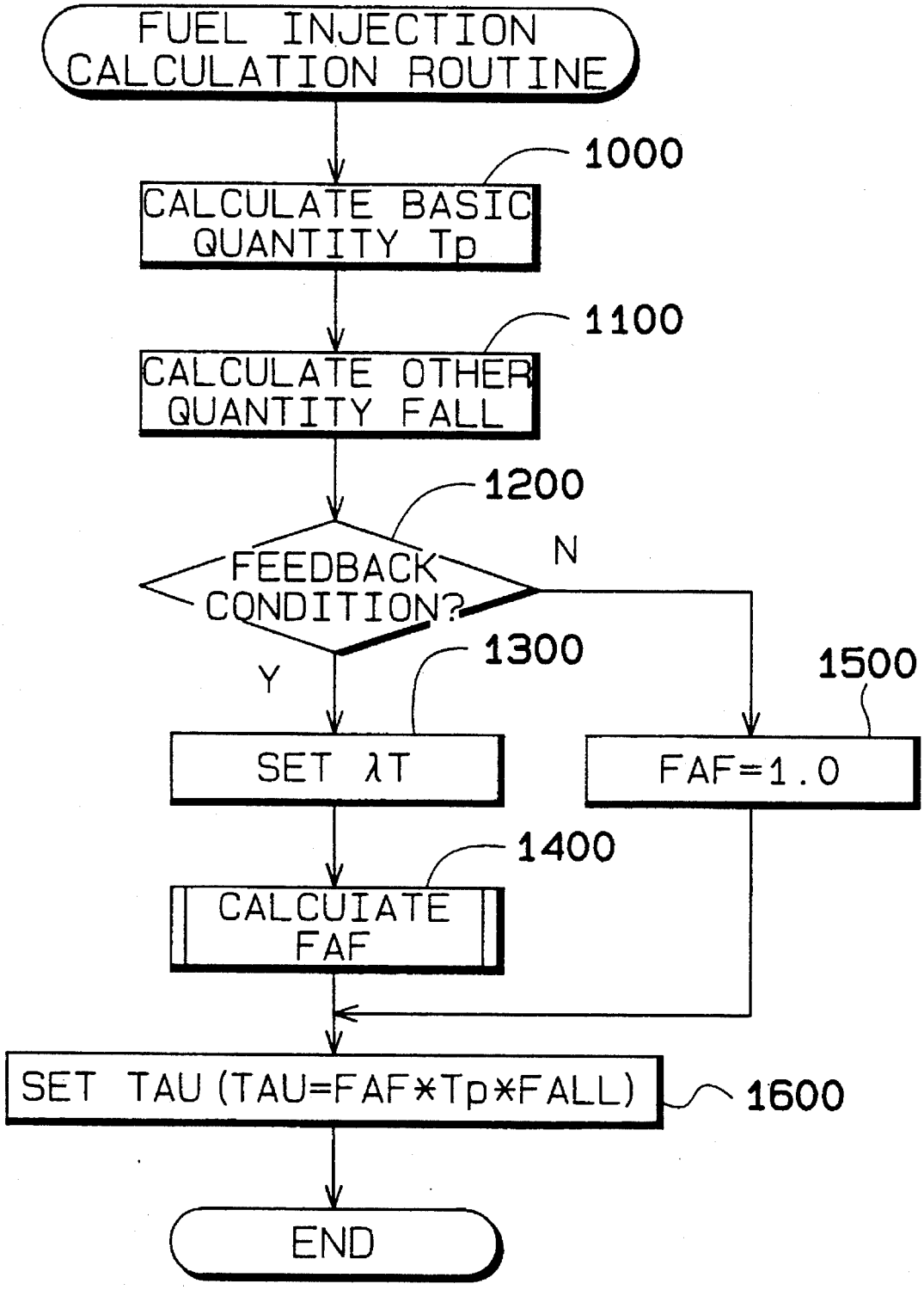
FIG. 7 is a flowchart of the calculation procedure when calculating fuel injection quantity as an example of operation of an apparatus of the embodiment of FIG. 6.

FIG. 7 is a flowchart for the control apparatus of the present embodiment, indicating the calculation routine of the fuel injection valves 26 which is executed when the electronic control unit 20 controls the above-mentioned air-fuel ratio.

Figure 8:
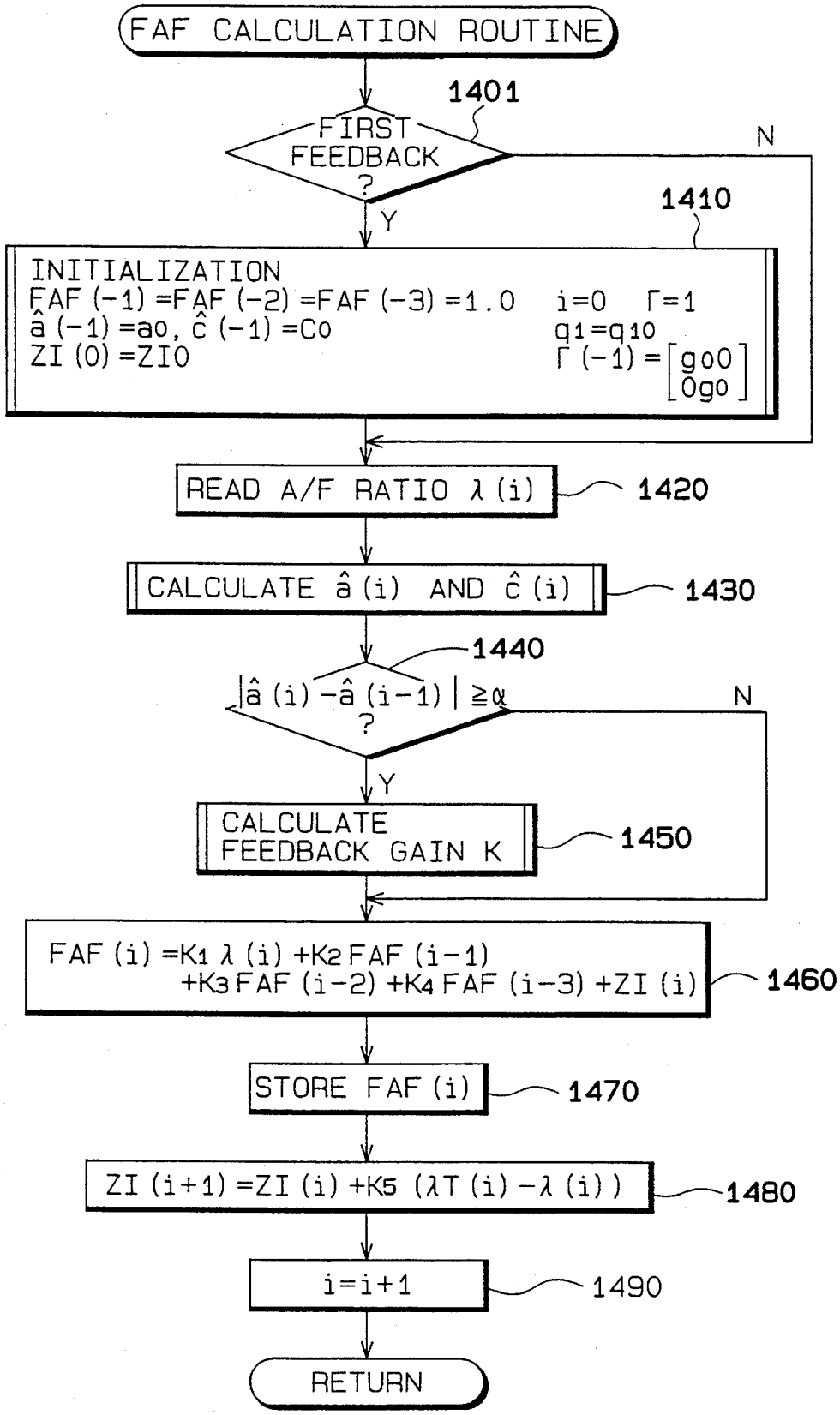
FIG. 8 is a flowchart of the calculation procedure of the air-fuel ratio compensation coefficient FAF executed by the air-fuel ratio compensation coefficient calculation section shown in FIG. 6.

Briefly, the electronic control unit 20 first determines, through the basic fuel injection quantity calculation section 206, the basic fuel injection quantity Tp of the foregoing fuel injection valves 26 on the basis of, for example, the calculation of the foregoing equation (32) or on the basis of access to the map (ROM) (step 1000). After determining the above-mentioned compensation quantities FALL through the other compensation quantity calculation section 207 (step 1100), then on condition that the feedback condition of the feedback system shown in FIG. 6 (i.e., whether the foregoing air-fuel ratio sensor 35 has reached a temperature allowing normal operation, and so on) has been fulfilled (step 1200), the foregoing target air-fuel ratio λT is set (step 1300). Having set the target air-fuel ratio λT in this manner, the electronic control unit 20 then initiates calculation of the air-fuel ratio compensation coefficient FAF so that the air-fuel ratio λ detected through the above-mentioned air-fuel ratio sensor 35 approaches the target air-fuel ratio λT that has been set (step 1400). The calculation routine for this air-fuel ratio compensation coefficient FAF is shown in FIG. 8.

In this air-fuel ratio compensation coefficient FAF calculation routine, if the fulfillment of the foregoing feedback condition is the first after the startup of electronic control unit 20 (step 1401), then the electronic control unit 20 first performs what is known as initialization processing (step 1410). Here, initialization processing refers, for example, to processing for a specified area of the RAM 53 wherein a variable i representing the number of times of sampling is set equal to 0, and the air-fuel ratio compensation coefficient FAF, the estimated quantities of the model constants, the above-mentioned symmetrical matrix Γ (GAMMA), and so on are set to their respective initial values. Additionally, in this embodiment, the weight coefficient q1 in the foregoing evaluation function (equation (60)) is initialized to its initial value of q10, and the other weight coefficient r is initialized to "1."

Figure 9:
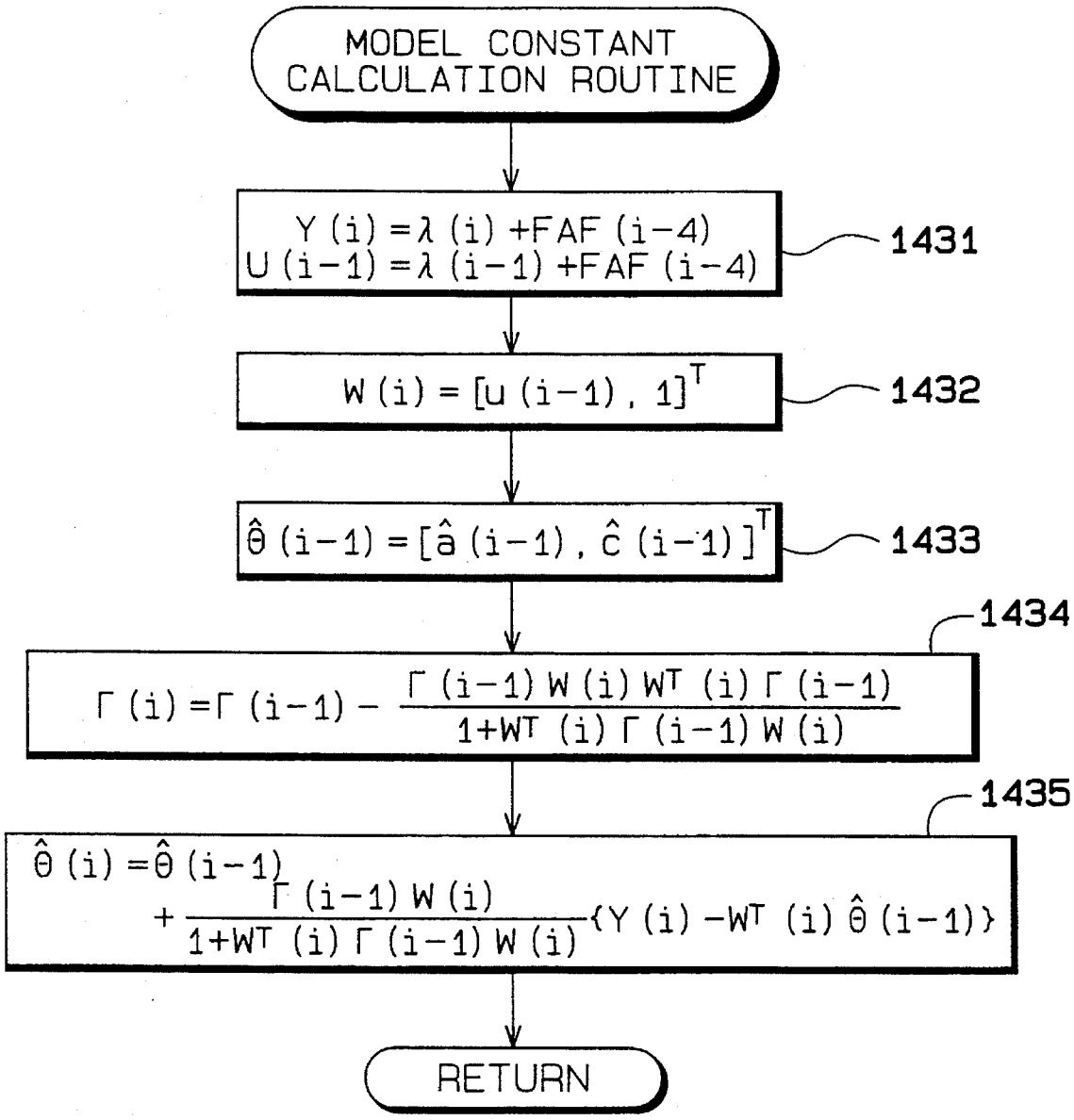
FIG. 9 is a flowchart of the model constant calculation procedure executed by the constant calculation section shown in FIG. 6.

Next, after the electronic control unit 20 reads the actual air-fuel ratio λ(i) output from the air-fuel ratio sensor 35 via the input port 56 (step 1420), the realtime calculation of the model constants (adaptive identification) described above begins (step 1430). This model constant calculation routine is shown in FIG. 9.

That is, when performing this model constant calculation, the electronic control unit 20 first sets the relationship between the foregoing air-fuel ratio λ(i) which has been read in and the value of the FAF(i–4) calculated in the past through the air-fuel ratio compensation coefficient calculation section 205' (if there is no corresponding value, then the initialized value or the previously calculated value) as well as the relationship between the previously read air-fuel ratio λ(i–1) and the value of the FAF (i–4) calculated in the past through the air-fuel ratio compensation coefficient calculation section 205' (if there is no corresponding value, then the initialized value or the previously calculated value) according to the foregoing equation (37) (step 1431), then determines the measurement value vector and parameter vector according to the foregoing equation (39) (steps 1432 and 1433), introduces the 2×2 symmetrical matrix Γ (GAMMA) represented in the foregoing equations (42) and (43) (step 1434), then executes the foregoing equation (40) (step 1435). The model constants a and c obtained as a result of this are then returned to the air-fuel ratio compensation coefficient FAF calculation routine indicated in FIG. 8.

Having determined the model constants in this manner, then in the air-fuel ratio compensation coefficient FAF calculation routine shown in FIG. 8, the electronic control unit 20 determines the difference between the foregoing constant a(i) which has been determined and the constant a(i–1) determined in the previous processing, and compares this difference with the arbitrary constant α (step 1440). This processing is done in order to decide whether a fluctuation has been induced in the engine 10 taken as the controlled object. Employed as this arbitrary constant α is a boundary value based on experience which allows employment of the identical feedback gain with no particular problem in terms of control as the optimal feedback gain described above, even if a fluctuation has been induced in the controlled object. Because of this, if the decision "NO" is made in the comparison processing of the step 1440, it means that a fluctuation which necessitates a change in the optimal feedback gain has not yet been induced in the foregoing adaptively-identified controlled object; conversely, if the decision "YES" is made, it means that a fluctuation which is sufficiently large to necessitate a change in the optimal feedback gain has been induced in the adaptively-identified controlled object.

Figure 10:
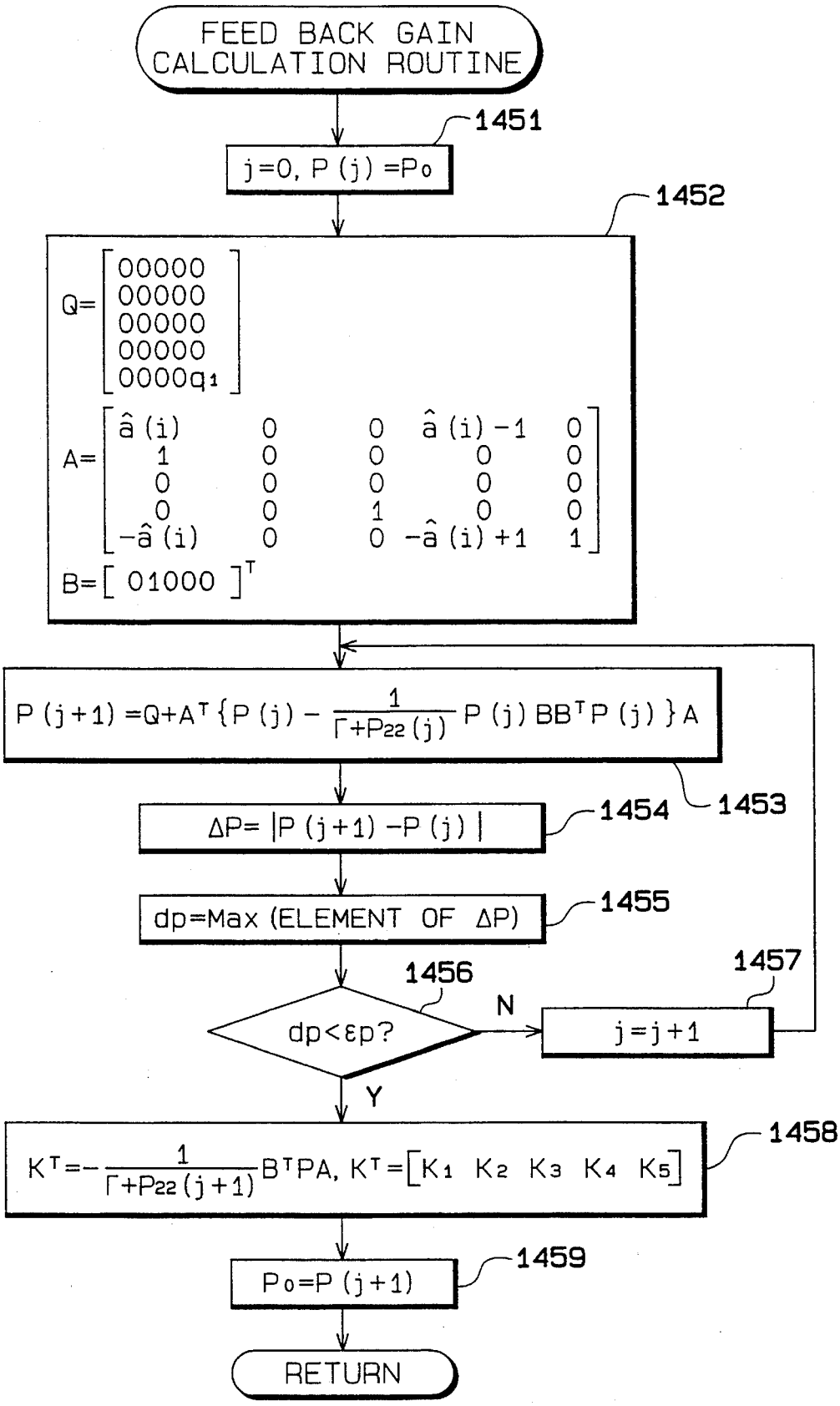
FIG. 10 is a flowchart of the feedback gain constant calculation procedure executed by the feedback gain calculation section shown in FIG. 2.
Figure 11:
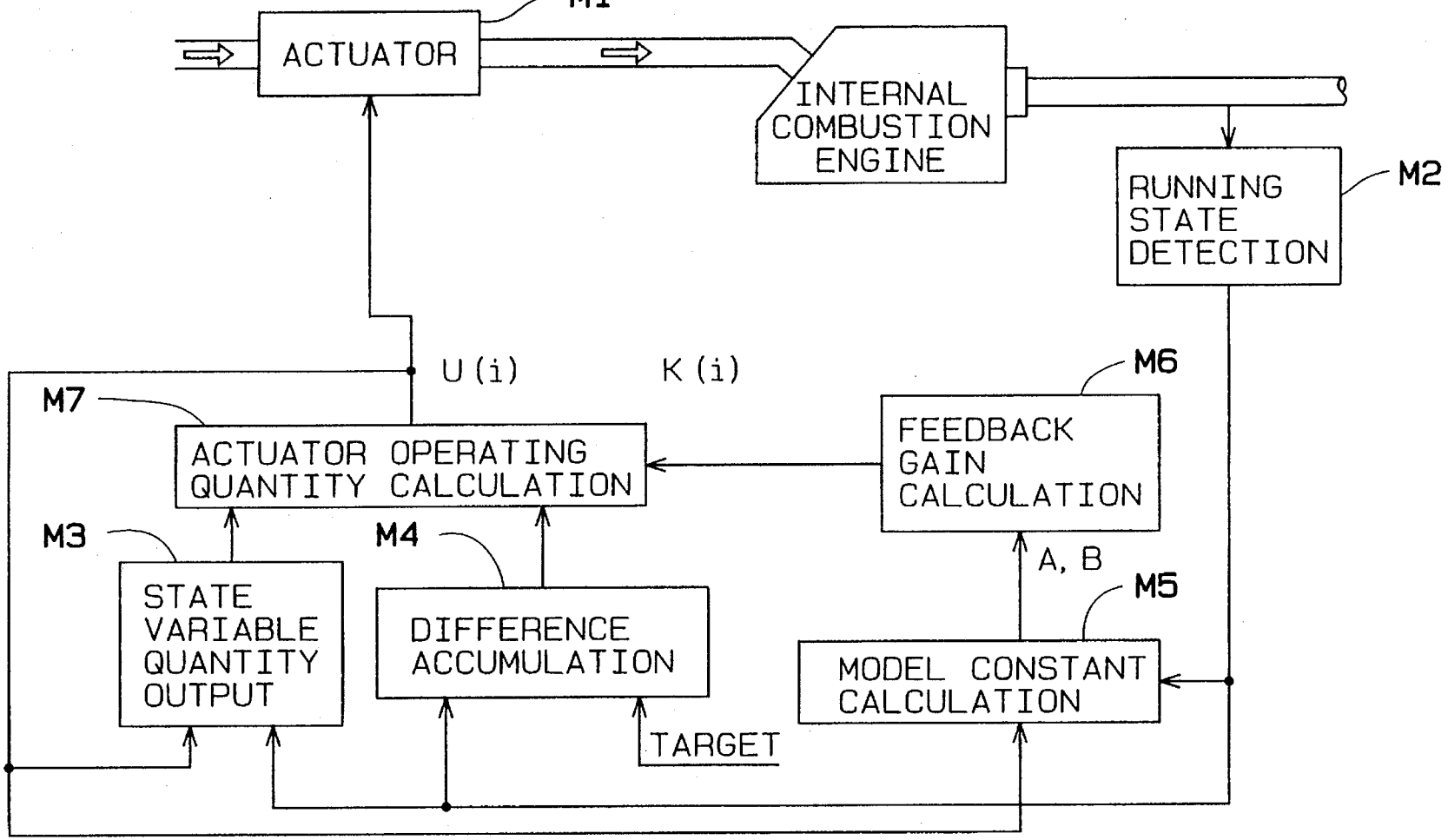
FIG. 11 is a structural diagram of the present invention.

Accordingly, in the above-mentioned comparison processing in the step 1440, the electronic control unit 20 recalculates the feedback gain K only in the case when the decision "YES" is made (step 1450). The feedback gain calculation routine is shown in FIG. 10.

When performing this feedback gain calculation, the electronic control unit 20 first initializes the number of times of execution of control j and the above-mentioned symmetrical matrix P (step 1451), then, on the basis of the definitions of "Q," "A," and "B" according to the foregoing equations (64), (55) and (56) (step 1452), executes processing to determine the value P on the basis of the above-mentioned equation (65) (step 1453). Here, in short, the differences of all 5×5 elements forming the symmetrical matrix P are determined (step 1454), and the largest difference thereof is extracted as dp (step 1455). When this largest difference dp has become smaller than a specified value εp, the convergence of the value of P is completed and the above-mentioned unique P is understood to have been determined (step 1456), and until that time the processing of these steps 1453 to 1456 is reiterated while incrementing the number of times of execution of control j (step 1457). When the above-mentioned unique P is obtained, it is substituted in the foregoing equation (61) to determine the optimal feedback gain K (step 1458), then processing is performed to take the value of the above-mentioned P which has been obtained as the next initial value (step 1459), and this determined feedback gain K (K1, K2, K3, K4, and K5) is returned to the air-fuel ratio compensation coefficient FAF calculation routine shown in FIG. 8.

In the air-fuel ratio compensation coefficient FAF calculation routine shown in FIG. 8, the electronic control unit 20 then executes the foregoing equation (58), employing this optimal feedback gain K (K1, K2, K3, K4, and K5) which has been determined or which has been set at that time, and performs processing to determine the operating quantity of the air-fuel ratio compensation coefficient FAF (i) (step 1460).

When the electronic control unit 20 determines the air-fuel ratio compensation coefficient FAF in this manner, this determined air-fuel ratio compensation coefficient FAF is stored or updated in a specified area of the RAM 53 (step 1470). Thereafter, the electronic control unit 20 determines and accumulates the difference between the target air-fuel ratio λT (i) and the actual air-fuel ratio λ(i) on the basis of the foregoing equation (59) (step 1480), then, after incrementing by 1 the value of the variable i of the above-mentioned number of times of execution of control (step 1490), returns the air-fuel ratio compensation coefficient FAF determined and stored as described above to the fuel injection quantity calculation routine shown in FIG. 7.

Accordingly, the electronic control unit 20 has obtained all elements for determining the fuel injection quantity, and in the fuel injection quantity calculation routine shown in FIG. 7, it executes setting of the fuel injection quantity TAU through the multiplier 208 (step 1600). As has been previously described, this setting of the fuel injection quantity TAU is performed through the operation (multiplication) of the equation (33). In the injection execution process of a known angle synchronization routine (not shown; this routine includes injection processing, ignition processing, and so on executed in synchronization with the angle of rotation of the crankshaft of the engine 10), the fuel injection quantity TAU which has been set in this manner utilizes the actual operating quantity of the foregoing fuel injection valves 26 as the determining signal. Additionally, in decision of fulfillment of the feedback condition of the fuel injection quantity calculation routine (step 1200), in the case where it is decided that the feedback condition has not yet been fulfilled because the above-mentioned air-fuel ratio sensor 35 has not reached operating temperature or for a similar reason, the foregoing air-fuel ratio compensation coefficient FAF is not calculated, and the value of the air-fuel ratio compensation coefficient FAF is fixed at "1.0" (step 1500) and the fuel injection quantity TAU is set.

In this manner, according to the control apparatus of this embodiment as well, modeling of the controlled object is performed in realtime in order to control the air-fuel ratio of the engine 10, and moreover, the model constant is employed to calculate the optimal feedback gain. Accordingly, even if some fluctuation should occur in the engine 10 approximated as this dynamic model, the effect it exerts on the control result is naturally suppressed. Because of this, constantly stabilized control which conforms with the periodic state of the engine 10 is also maintained for the control of the air-fuel ratio.

Furthermore, as is shown in FIG. 8 (particularly the step 1440), the control apparatus of the present embodiment is structured so as to determine the presence or absence of fluctuation in the controlled object and recalculate the feedback gain only after the amount of fluctuation has surpassed a specified quantity, and so is undoubtedly superior in terms of processing efficiency, but is not exclusively restricted to such a structure. That is to say, for the sake of convenience, a structure may be adopted whereby the processing of the foregoing step 1440 is omitted and the calculation of the feedback gain is also performed in realtime.

Additionally, in the control apparatus of the present embodiment, in consideration of the feedback efficiency of the feedback system, the basic injection quantity Tp and the other compensation quantities FALL which are among the operating quantities of the foregoing fuel injection valves 26 are respectively calculated separately through the basic fuel injection quantity calculation section 206 and the other compensation quantity calculation section 207, and only the air-fuel ratio compensation coefficient FAF calculated through the air-fuel ratio compensation coefficient calculation section 205' is fed back respectively to the state variable quantity control output section 201' and model constant calculation section 203'; in addition to, however, it is also possible, for example, to provide a means (actuator operating quantity calculation means) which performs batch calculation of the foregoing fuel injection valves 26 operating quantity or, in short, the foregoing fuel injection quantity TAU itself, in place of the air-fuel ratio compensation coefficient calculation section 205', basic fuel injection quantity calculation section 206, other compensation quantity calculation section 207, and multiplier 208, thereby adopting a structure whereby this calculated fuel injection quantity TAU is fed back respectively to the state variable quantity control output section 201' and model constant calculation section 203'.

Additionally, even in the case whereby only the air-fuel ratio compensation coefficient FAF is fed back respectively to the state variable quantity control output section 201' and model constant calculation section 203', in the case where the basic fuel injection quantity calculation section 206' calculates the foregoing basic injection quantity Tp as the obtained value which also includes the foregoing compensation quantities FALL, the provision of the other compensation quantity calculation section 207 is also obviated.

According to the present invention, as has been described above, it becomes possible to maintain constantly stabilized control which conforms with the periodic state of the internal combustion engine, and even if some fluctuation should occur in the engine approximated as a dynamic model, the effect of error it exerts on the control result is optimally suppressed.

We claim:

1. An apparatus for controlling an internal combustion engine, said apparatus comprising:

an electronic control unit for modelling behavior of said internal combustion engine based on a dynamic model of said behavior and for producing operating control signals based on said modelling;

means for detecting a running state of said internal combustion engine and for providing running state signals representing said running state to said electronic control unit; and an actuator for controlling said running state of said internal combustion engine based on at least one of said control signals produced by said electronic control unit, wherein said electronic control unit comprises input means, output means, memory means and microprocessor means programmed to perform the steps of:

(a) obtaining said running state signals from said running state detection means via said input means;

(b) maintaining and outputting state variables based on present and past values of said running state signals and on present and past values of said produced operating control signals;

(c) calculating, in realtime, model constants of said dynamic model on the basis of the value of a past operating control signal as well as on the values of present and past running state signals;

(d) calculating an optimal feedback gain on the basis of said calculated model constants;

(e) determining and accumulating a difference between a target running state signal and said obtained running state signals;

(f) calculating a present operating control signal for said actuator on the basis of: said calculated optimal feedback gain, said accumulated difference value and said maintained state variables; and (g) providing to said actuator via said output means, said present operating control signal as said at least one control signal.

2. An apparatus as in claim 1, wherein said model constants have a fluctuation quantity and wherein said microprocessor means is also programmed to perform the step of:

monitoring said fluctuation quantity, and wherein said step of calculating said optimal feedback is performed only when it is determined based on said monitoring that said fluctuation quantity exceeds a specified quantity.

3. An apparatus for controlling an internal combustion engine, said apparatus comprising:

an electronic control unit for modelling behavior of said internal combustion engine based on a dynamic model of said behavior and for producing an idle air operating control signal based on said modelling;

means for detecting a speed of said internal combustion engine during idling of said engine and for providing a signal representing said speed to said electronic control unit; and idle air amount operation means for operating on an idle air amount of said internal combustion engine during said idling, said operating based on said idle air operating control signal produced by said electronic control unit, wherein said electronic control unit comprises input means, output means, memory means and microprocessor means programmed to perform the steps of:

(a) obtaining said speed signals from said speed detection means via said input means;

(b) maintaining and outputting state variables based on present and past values of said speed signals and on present and past values of said produced idle air operating control signals;

(c) calculating, in realtime, model constants of said dynamic model on the basis of the value of a past idle air operating control signal as well as on the values of present and past speed signals;

(d) calculating an optimal feedback gain on the basis of said calculated model constants;

(e) determining and accumulating a difference between a target speed signal and said obtained speed signals;

(f) calculating a present idle air operating control signal for said idle air amount operation means on the basis of: said calculated optimal feedback gain, said accumulated difference value and said maintained state variables; and (g) providing to said idle air amount operation means via said output means, said present idle air operating control signal.

4. A control apparatus for an internal combustion engine comprising:

an electronic control unit for modelling behavior of said internal combustion engine based on a dynamic model of said behavior and for producing a fuel supply control signal based on said modelling;

fuel supply operation means for controlling a fuel supply amount for said internal combustion engine based on said fuel supply control signal;

means for detecting an air-fuel ratio of said internal combustion engine on the basis of exhaust gas of said internal combustion engine and for providing a signal representing said detected air-fuel ratio to said electronic control unit;

wherein said electronic control unit comprises input means, output means, memory means and microprocessor means programmed to perform the steps of:

(a) obtaining said air-fuel ratio signal from said air-fuel ratio detection means via said input means;

(b) maintaining and outputting state variables based on present and past values of said obtained air-fuel ratio signal as well as on present and past values of said produced fuel supply control signals;

(c) calculating, in realtime, model constants of said dynamic model on the basis of the value of a past fuel supply control signal as well as on the values of present and past air-fuel ratio signals;

(d) calculating an optimal feedback gain on the basis of said calculated model constants;

(e) determining and accumulating a difference between a target air-fuel ratio signal and said obtained air-fuel ratio signal;

(f) calculating a present fuel supply control signal for said fuel supply operation means on the basis of: said calculated optimal feedback gain, said accumulated difference value and said maintained state variables; and (g) providing to said fuel supply operation means via said output means, said present fuel supply control signal.

5. A control apparatus for an internal combustion engine according to claim 4, wherein said microprocessor means is further programmed to perform the steps of:

calculating a compensation coefficient of said air-fuel ratio on the basis of: said calculated optimal feedback gain, a state variable stored in said memory means and an accumulated difference value;

calculating a basic quantity to be operated on by said fuel supply operation means; and calculating an operating quantity of said fuel supply operation means as said basic operating quantity multiplied by said calculated compensation coefficient, wherein said step of calculating a present fuel supply control signal is performed on the basis of said compensation coefficient.

6. A control apparatus according to claim 1, wherein said step of maintaining includes the step of:

calculating, without using an observer represented by a matrix, said state variables using said present and past values of said running state signals and said present and past values of said produced operating control signals.

* * * * *